US005739453A

United States Patent [19]

Chihana et al.

[11] Patent Number: 5,739,453

[45] Date of Patent: Apr. 14, 1998

[54] ELECTRONIC MUSICAL INSTRUMENT WITH AUTOMATIC PERFORMANCE FUNCTION

[75] Inventors: Masanobu Chihana; Hiroyuki Torimura, both of Hamamatsu, Japan

[73] Assignee: Yamaha Corporation, Japan

[21] Appl. No.: 403,500

[22] Filed: Mar. 14, 1995

[30] Foreign Application Priority Data

Mar. 15, 1994 [JP] Japan ..... 6-043841
Jul. 7, 1994 [JP] Japan ..... 6-156240

[51] Int. Cl.[6] ..... G10H 1/18; G10H 7/00

[52] U.S. Cl. ..... 84/615; 84/611; 84/619

[58] Field of Search ..... 84/609–611, 615, 84/619, 634–636, 649–651, 653, 657

[56] References Cited

U.S. PATENT DOCUMENTS

| | | | |
|---|---|---|---|
| 4,887,503 | 12/1989 | Suzuki | 84/613 |
| 5,363,735 | 11/1994 | Kondo | 84/622 |
| 5,391,829 | 2/1995 | Hasebe et al. | 84/622 |
| 5,406,023 | 4/1995 | Nagahama | 84/622 |
| 5,461,192 | 10/1995 | Imaizumi | 84/634 |
| 5,483,018 | 1/1996 | Aoki et al. | 84/611 |

FOREIGN PATENT DOCUMENTS 2-39196 2/1990 Japan .

*Primary Examiner*—William M. Shoop, Jr.
*Assistant Examiner*—Jeffrey W. Donels
*Attorney, Agent, or Firm*—Graham & James LLP

[57] ABSTRACT

An electronic musical instrument including: a mode selecting unit for selecting a mode from a plurality of modes including an automatic performance mode and a manual performance mode; a musical style storage for storing performance atmosphere data of a plurality of musical styles; a performance data storage for storing performance data of a plurality of programs each matching one of the musical styles; a musical style selection member responsive to a manipulation by a performer for selecting a musical style from the performance atmosphere data stored in the musical style storage; a musical tone signal generator for generating a musical tone signal in accordance with a musical tone parameter; and a musical tone parameter generating unit for generating and outputting the musical tone parameter to the musical tone signal generator during the automatic performance mode, in accordance with the performance atmosphere data representing the musical style selected by the musical style selection member and the performance data of a program suitable for the musical style.

21 Claims, 26 Drawing Sheets

| | |
|---|---|
| MODE 0 | MANUAL PERFORMANCE |
| MODE 1 | DEMONSTRATION PROGRAM SELECTION |
| MODE 2 | ALL DEMONSTRATION PROGRAM PERFORMANCE |
| MODE 3 | SINGLE DEMONSTRATION PROGRAM PERFORMANCE |

| | |
|---|---|
| MODE 0 | MANUAL PERFORMANCE |
| MODE 1 | DEMONSTRATION PROGRAM SELECTION |
| MODE 2 | ALL DEMONSTRATION PROGRAM PERFORMANCE |
| MODE 3 | SINGLE DEMONSTRATION PROGRAM PERFORMANCE |
| MODE 4 | TRAINING PROGRAM PERFORMANCE |

ELECTRONIC MUSICAL INSTRUMENT WITH AUTOMATIC PERFORMANCE FUNCTION

BACKGROUND OF THE INVENTION

1. Field of the Invention

The invention relates to an electronic musical instrument, and more particularly to an electronic musical instrument capable of rendering a demonstration performance.

2. Description of the Related Art

An electronic musical instrument with an automatic performance function selects one of a plurality of preserved demonstration programs and automatically plays the selected demonstration program. An electronic musical instrument has been proposed which can automatically play a demonstration program having the tone color selected by an operator by manipulating a corresponding tone color switch mounted on a panel of the instrument (Japanese Patent Laid-open Publication No. 2-39196). If each demonstration program is recorded to have a particular tone color, the tone color suitable for the program can be automatically reproduced by the electronic musical instrument. It is also possible to play a demonstration program having the rhythm selected by an operator by manipulating a corresponding rhythm switch.

Such an electronic musical instrument with an automatic performance function is suitable for playing a demonstration program with a particular tone color or rhythm for the presentation at a musical instrument shop or the like. However, it is not suitable for playing a demonstration program of a particular musical genre or style, for example, of a musical style of jazz. Therefore, a customer's need of listening to a demonstration program of a particular musical style cannot be satisfied.

Programs of various musical styles can be played on an electronic musical instrument by changing a combination of tone color and rhythm even if the same tone color or rhythm is selected. For example, programs of various musical styles such as a jazz style and a ballad style can be played on an electronic musical instrument by changing the combination of tone color or rhythm even if the same piano tone color is selected. However, in this case, if an operator selects only a piano tone color by manipulating a corresponding tone color switch without selecting a rhythm, the musical style cannot be changed.

Furthermore, for automatic performance of a demonstration program, for example, in a jazz style, it is difficult for an operator to determine, for example, which tone colors among piano and trumpet tone colors are selected by designating a particular tone color select switch.

SUMMARY OF THE INVENTION

An object of the present invention is to provide an electronic musical instrument capable of rendering a demonstration performance matching a particular music style.

According to one aspect of the present invention, an electronic musical instrument is provided which includes: musical style storage means for storing performance atmosphere data (GD) of a plurality of musical styles; performance data storage means for storing performance data (MD) of a plurality of programs suitable for each of the plurality of musical styles; musical style selecting means for selecting a musical style from the performance atmosphere data stored in the musical style storage means; musical tone signal generating means for generating a musical tone signal corresponding to a musical tone parameter, and first musical tone parameter supply means for supplying the musical tone parameter to the musical tone signal generating means in accordance with the performance atmosphere data representing the musical style selected by the musical style selecting means and the performance data suitable for the selected musical style.

An optimum performance atmosphere suitable for a musical style selected by an operator can be set and a program suitable for the selected musical style can be automatically played on the electronic musical instrument.

BRIEF DESCRIPTION OF THE DRAWINGS

FIG. 1A shows the format of registration data, FIG. 1B shows the format of automatic performance data of demonstration programs, and FIG. 1C shows the format of rhythm pattern data.

FIG. 22A shows the format of registration data, FIG. 22B shows the format of automatic performance data of demonstration programs, FIG. 22C shows the format of automatic performance data of training programs, and FIG. 22D shows the format of rhythm pattern data.

DETAILED DESCRIPTION OF THE PREFERRED EMBODIMENTS

Figure 2:
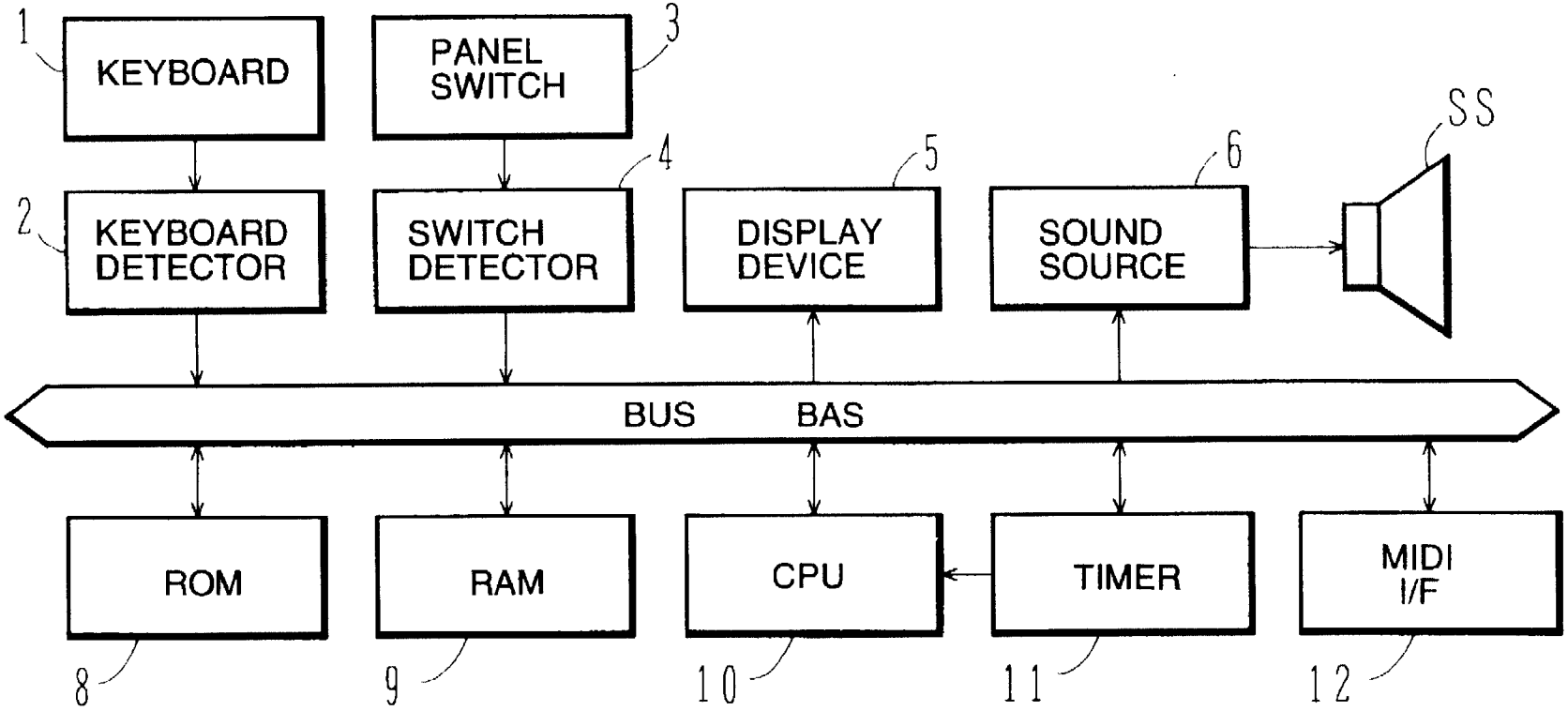
FIG. 2 is a block diagram showing an example of the structure of an electronic musical instrument system with an automatic performance function according to an embodiment of the invention.

FIG. 2 is a block diagram showing an example of an electronic musical instrument system having an automatic performance function according to an embodiment of the invention.

A keyboard 1 has a plurality of keys, and generates a key manipulation signal such as pitch data (key code), key depressing speed (initial touch), and key depressing pressure (after touch) when a player depresses or releases a key. A keyboard detector 2 detects a key event upon reception of a signal generated by the keyboard 1, and stores data such as the key code, touch, and event type (on/off) of the manipulated key, in a register thereof. A CPU 10 reads the data stored in the register of the keyboard detector 2, performs various processes, and thereafter deletes the data stored in the register.

Panel switches 3 are switches for instructing volume adjustment, tone color selection, rhythm selection, automatic performance start, and the like to be described later. Each panel switch 3 generates a signal when it is manipulated. Upon reception of a signal from the panel switch 3, a switch detector 4 supplies switch data to CPU 10 which in turn displays the state of the panel switch 3 or an automatic performance notice on a display device 5. The display device 5 is, for example, a liquid crystal device, light emitting diodes (LED), or other devices.

CPU 10 reads and processes a key event from the keyboard detector 2 and switch data from the switch detector 4 to generate a musical tone parameter necessary for generating a musical tone signal. The musical tone parameter is supplied to a sound source 6 which in turn generates a musical tone signal. The musical tone signal is supplied to a sound system SS to generate a sound.

A ROM 8 stores various programs. In accordance with the programs, CPU 10 performs various processes by using a working memory such as a register and a buffer in a RAM 9. In addition to the programs, ROM 8 stores data necessary for automatic performance. Upon reception of an automatic performance start instruction from the switch detector 4, CPU 10 reads automatic performance data from ROM 8 and supplies a musical tone parameter to the sound source 6.

A musical instrument digital interface (MIDI) 12 is used for transferring MIDI data between CPU 10 and an external system.

A timer 11 generates a timing signal and supplies an interrupt signal to CPU 10 at a predetermined time interval.

ROM 8, RAM 9, keyboard detector 2, switch detector 4, display device 5, sound source 6, timer 11, and MIDI interface 12 are controlled by CPU 10 via a bus 13.

Figure 3:
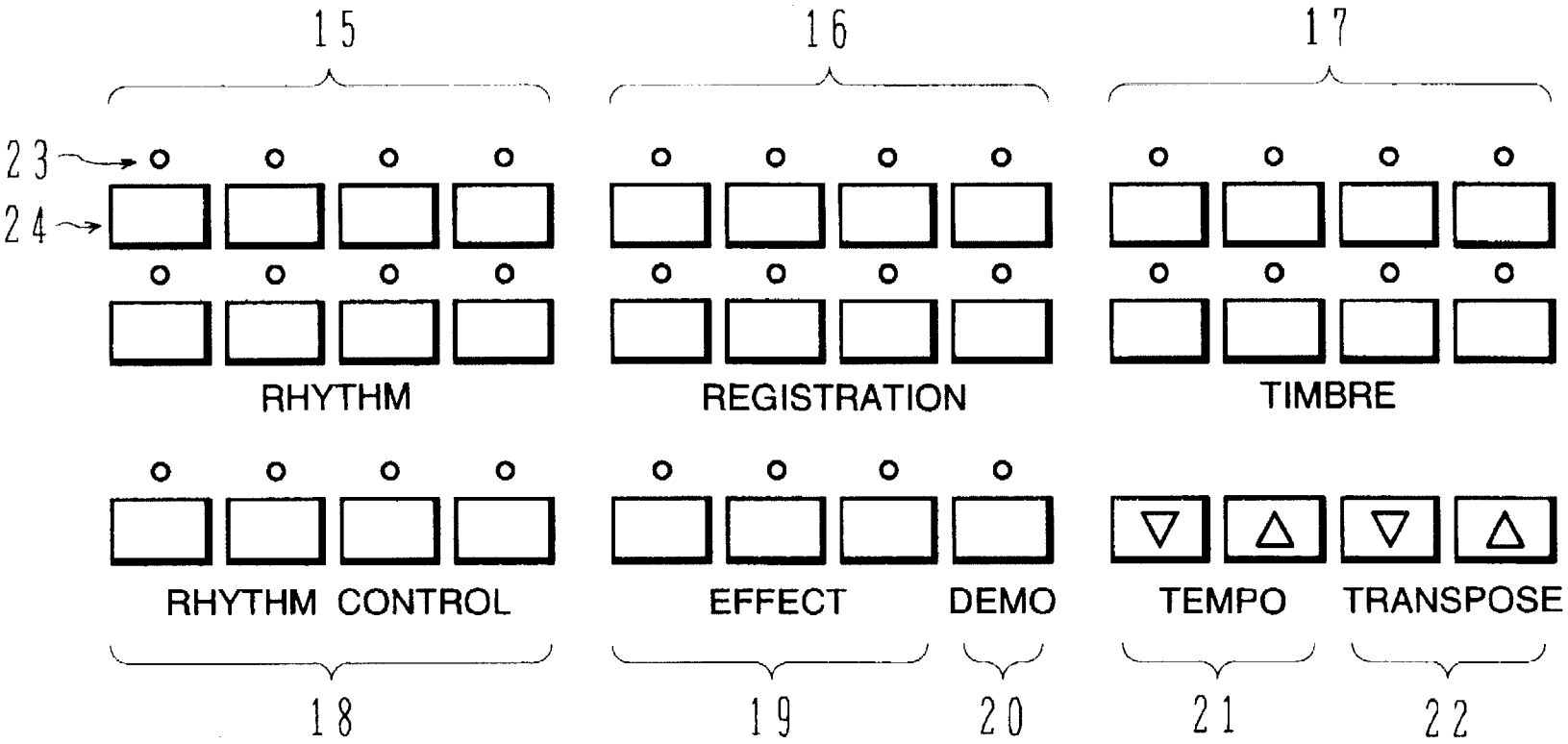
FIG. 3 is a schematic diagram showing an example of the structure of the main part of the switch panel shown in FIG. 2

FIG. 3 shows an example of the structure of the main part of panel switches 3 shown in FIG. 2. Panel switches 3 include rhythm switches 15, registration switches 16, tone color (timbre) switches 17, rhythm control switches 18, effect switches 19, a demonstration switch 20, tempo switches 21, transposition switches 22, and other switches.

The switches 24 except the tempo switches 21 and transposition switches 22 have corresponding LEDs 23 which are turned on when the switches are manipulated. The tempo switches 21 and transposition switches 22 have no LED.

The tone color switches 17 include eight switches corresponding to eight tone colors such as piano and violin. After the power is turned on, a manual performance mode starts. When one of the tone color switches 17 is depressed, the corresponding tone color is set and its LED is turned on.

The rhythm switches 15 includes eight switches corresponding to eight rhythms such as disco music and waltz music to be performed by a drum, a bass, and the like. When one of the rhythm switches 15 is depressed in the manual performance mode, the corresponding rhythm is set and its LED is turned on.

The rhythm control switches 18 are used for the control of, for example, rhythm start/stop, rhythm introduction/ending, fill-in, and synchronous start. When one of the rhythm control switches 18 is depressed, the corresponding rhythm control is performed and its LED is turned on.

The effect switches 19 are used for adding effects such as chorus, sustain, and reverberation. When one of the effect switches 19 is depressed in the manual performance mode, the corresponding effect is set and its LED is turned on.

The demonstration switch 20 is used for switching between the manual performance mode and the automatic performance mode of a demonstration program. The tempo switches 21 are used for quickening or slowing the tempo in the manual performance mode.

The transposition switches 22 are used for transposing a musical key in unit of semitone in the up/down directions. Musical key transposition can be performed independently both in the manual and automatic performance modes.

Musical key transposition data set in the manual performance mode is saved in the register of RAM when the mode is changed to the automatic performance mode. After the tone change data is saved, different musical key transposition data may be set in the automatic performance mode. When the manual performance mode is resumed, the musical key transposition data in the register may be read to perform the same tone change.

The registration switches 16 include eight switches corresponding musical styles represented by combinations of tone color, rhythm, effect, and the like. The musical styles are, for example, the Big Band Sound (jazz), a string orchestra, and a piano duo. Characters or symbol marks representing each musical style are attached to each registration switch 16. A performer can play a program in a desired musical style by selecting the registration switch, without separately selecting the tone color switch 17, rhythm switch 15, and the like.

When one of the registration switches 16 is depressed in the automatic performance mode, the tone color, rhythm, tempo, effect, and the like are set at the same time and its LED is turned on. The LEDs of the corresponding tone color switch 17, rhythm switch 15, and effect switch 19 are also turned on. Automatic performance data of a demonstration program corresponding to the depressed registration switch is read from ROM, and the program is automatically performed.

When one of the registration switches 16 is depressed in the manual performance mode, the tone color, rhythm, tempo, effect, and the like are set without permitting an automatic performance of a demonstration program. A performer can play at the same setting as the demonstration program so that the demonstration program can be trained effectively by the performer.

When the registration switch is depressed, the explanation of the musical style is displayed on the display device, facilitating the program performance.

Figure 1A:
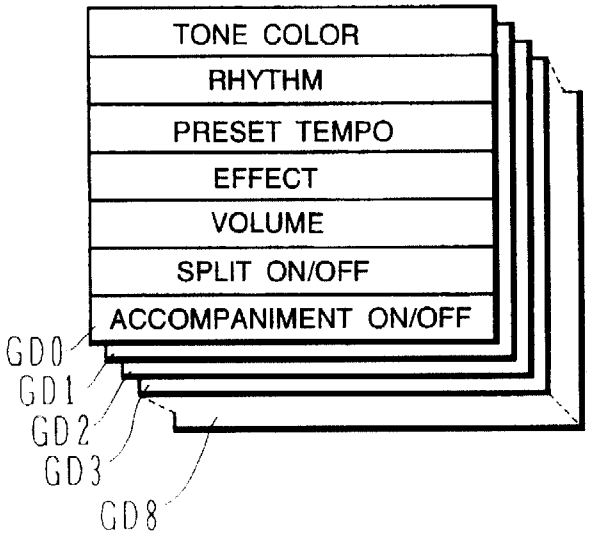
FIGS. 1A to 1C show the main formats of data stored in a ROM.
Figure 1B:
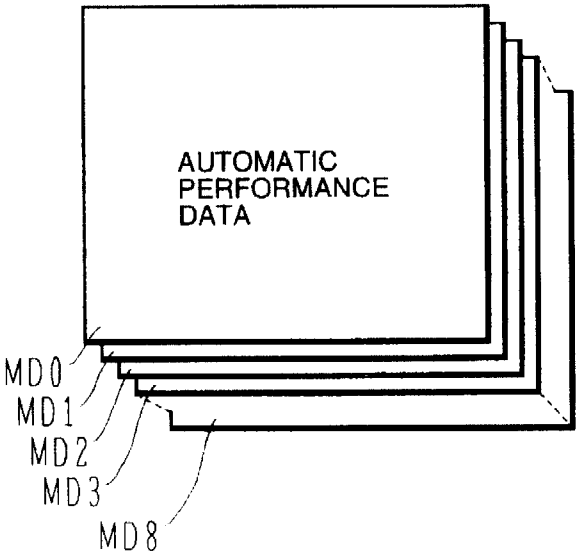
Figure 1C:
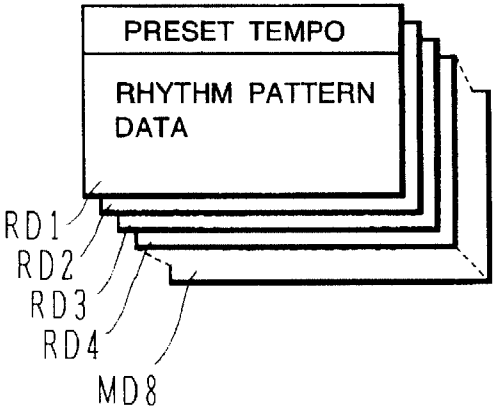

FIGS. 1A to 1C show the main formats of data in ROM.

FIG. 1A shows the format of registration data set when a registration switch is depressed. There are nine registration data GD0 to GD8 having the same format. The data GD1 to GD8 each are performance atmosphere data of a different musical style, and correspond to the eight registration switches 16.

For example, when the registration switch No.1 is depressed, the performance atmosphere of the registration data GD1 is set. The registration data GD0 cannot be selected by the registration switches, the details thereof will be described later.

The format of the data GD includes a tone color, a rhythm, a preset tempo, an effect, a volume, a split on/off, and an accompaniment on/off.

When the split is turned on, one stage keyboard can be used like a two-stage keyboard. For example, different tone colors can be set to the right and left halves of the one stage keyboard. In such a case, two tone colors of the right and left halves of the keyboard are stored as registration data. When the split is turned off, a single tone color is set to the one stage keyboard.

When the accompaniment is turned on, a program is automatically performed at predetermined rhythm by a drum part, a bass, and the like. When the accompaniment is turned off, automatic performance by other than the drum part is not effected.

FIG. 1B shows automatic performance data of a demonstration program. After the registration switch is selected and the registration data GD is set, the automatic performance data of the demonstration program is read from ROM. There are nine automatic performance data MD0 to MD8 of the nine demonstration programs. The automatic performance data MD1 to MD8 correspond to the eight registration switches of different musical styles. For example, when the registration switch No.1 is depressed in the automatic performance mode, the performance data MD1 of the demonstration program is read from ROM, and the program is automatically performed.

The registration data GD0 and the automatic performance data MD0 cannot be selected by the registration switch, and the demonstration program of the automatic performance data MD0 is automatically performed in the automatic performance mode when none of the registration switch is selected. After the demonstration program MD0 is performed, the demonstration programs MD1 to MD8 are sequentially performed in this order.

The registration data shown in FIG. 1A contains a rhythm and preset tempo suitable for a demonstration program. The tempo suitable for a demonstration program is a tempo suitable for the musical style represented by the combination of a tone color, rhythm, effect, and the like contained in the registration data. However, the tempo suitable for a demonstration program is not necessarily the same as the tempo of the rhythm itself.

FIG. 1C shows rhythm pattern data representing the tempo suitable for a rhythm. The rhythm pattern data is stored in ROM similar to the registration data and automatic performance data. There are eight rhythm pattern data RD1 to RD8 corresponding to the eight registration switches. The rhythm pattern data RD includes rhythm pattern data and preset tempo data suitable for the rhythm.

In the manual performance mode, the tempo set by the registration switch is generally used. If the tempo set by the registration switch is to be changed to a tempo suitable for the rhythm itself, the two up/down switches 21 shown in FIG. 3 are depressed at the same time.

When the two switches 21 are depressed, the preset tempo and rhythm pattern data shown in FIG. 1C are read and a program is automatically performed at the tempo suitable for the rhythm. A performer can play a program under automatic accompaniment at a changed tempo.

Instead of depressing the two tempo switches at the same time, another dedicated switch may be depressed or another switch shared in use with another function may be depressed.

Figures 4, 5:
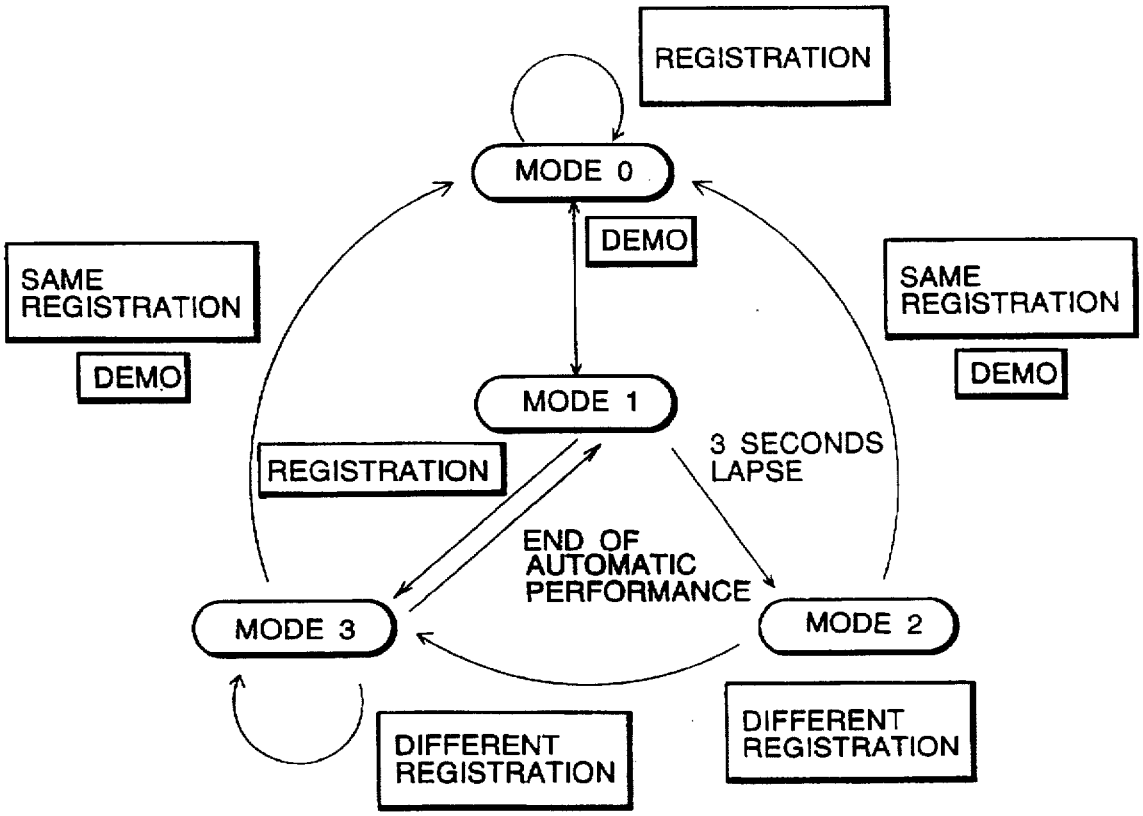
FIG. 4 is a table showing the operating modes of the electronic musical instrument.
FIG. 5 is a mode transition diagram showing transitions between the operating modes of the electronic musical instrument.

FIG. 4 shows operating modes of the electronic musical instrument which automatically or manually performs a program. The operating modes include four modes, Mode 0 to Mode 3.

Mode 0 is a manual performance mode. This mode is always set when a power is tuned on. When a registration switch is depressed in the manual performance mode, the tone color, rhythm, and the like of a desired musical style are set. A performer can play a program at a desired musical style.

Mode 1 is a demonstration program selection mode which allows a performer to select a desired program. When the demonstration switch 20 shown in FIG. 3 is depressed in Mode 0, the mode changes to Mode 1. When the demonstration switch 20 is depressed, LEDs of the registration switches 16 start being scanned to urge the performer to select the demonstration program for automatic performance. The performer can select one of the eight demonstration programs each having a particular musical style by selecting the registration switch 16. When one of the registration switches 16 is depressed, the corresponding musical style is selected and Mode 1 changes to Mode 3, and the LED scanning is terminated. If any registration switch 16 is not depressed in a predetermined time (e.g., 3 seconds), Mode 1 changes to Mode 2.

Mode 3 is a single demonstration performance mode which automatically performs a demonstration program of a musical style selected by the registration switch. One of the demonstration programs MD1 to MD8 shown in FIG. 1B corresponding to the depressed registration switch is automatically performed.

Mode 2 is an all demonstration program performance mode which automatically performs all the demonstration programs MD0 to MD8 shown in FIG. 1B and stored in ROM. All nine programs MD0 to MD8 are sequentially performed. The demonstration program MD0 is first performed, and thereafter the demonstration programs MD1 to MD8 are sequentially and repetitively performed.

The demonstration programs MD1 to MD8 are most suitable programs for producing the musical style corresponding to each registration switch. In addition to the demonstration programs MD1 to MD8, if there is a demonstration program capable of using the full functions of the electronic musical instrument, the demonstration effects can be enhanced. Such a demonstration program is registered as the program MD0. The program MD0 is preferably set to be an independent program rather than assigning it to one of the registration switches.

FIG. 5 is a transition diagram between the four operating Modes 0 to 3. When the power of the electronic musical instrument is turned on, Mode 0 is initially set to allow a performer to play a program.

When the registration switch is depressed in the manual performance Mode 0, the registration data corresponding to the depressed switch is set. The performer can play a program at the desired musical style in Mode 0.

When the demonstration switch 20 shown in FIG. 3 is depressed in Mode 0, the operating mode changes to Mode 1 to allow the performer to select a musical style. When the registration switch 16 is depressed in Mode 1, the operating mode changes to Mode 3 to start automatic performance at a musical style corresponding to the depressed switch, such as the Big Band Sound (jazz) and a string orchestra. When the automatic performance of the selected demonstration program is completed in Mode 3, the operation mode returns to Mode 1 to allow the performer to select a demonstration program.

If any registration switch 16 is not selected in 3 seconds in the demonstration program selection state of Mode 1, the operation mode changes to Mode 2 and the nine demonstration programs MD0 to MD8 are sequentially performed. The demonstration program MD0 is first performed. After the last demonstration program MD8 is performed, the demonstration programs MD1 to MD8 are sequentially and repetitively performed. Instead of starting from the demonstration program MD0, one of the demonstration programs MD1 to MD8 corresponding to the depressed registration switch may be first performed.

Consider now the case where a registration key is again depressed while the single demonstration program is automatically performed in Mode 3. If a registration switch different from the musical style of the demonstration program under performance is depressed, the mode is not changed and the demonstration program of the musical style corresponding to the newly depressed registration switch is automatically performed. If the same registration switch as the musical style of the demonstration program under performance is depressed, the mode changes to Mode 0 to allow the performer to play a program at the same musical style by using the demonstration program as the training model.

Consider the case where a registration switch is depressed in the all demonstration performance Mode 2. In Mode 2, as the nine demonstration programs are automatically performed in sequence, the LEDs of the registration switches are sequentially turned on. If a registration switch different from the musical style of the demonstration program under performance is depressed, the mode is changed to Mode 3 to start automatic performance of the demonstration program of the musical style corresponding to the depressed registration switch. If the same registration switch as the musical style of the demonstration program under performance is depressed, the mode changes to Mode 0 to allow the performer to play a program at the same musical style.

If the demonstration switch is depressed in any of Modes 1 to 3, the mode changes to Mode 0 to allow the performer to play a program.

When the automatic performance of the demonstration program in Mode 3 is completed, the mode changes to Mode 1 to allow the performer to select a demonstration program. If a registration switch is selected in this demonstration program selection state, the mode changes to Mode 3. If a registration switch is not selected, the mode may be changed to other modes such as the manual performance Mode 1, instead of entering the all demonstration performance Mode 2.

Figure 6:
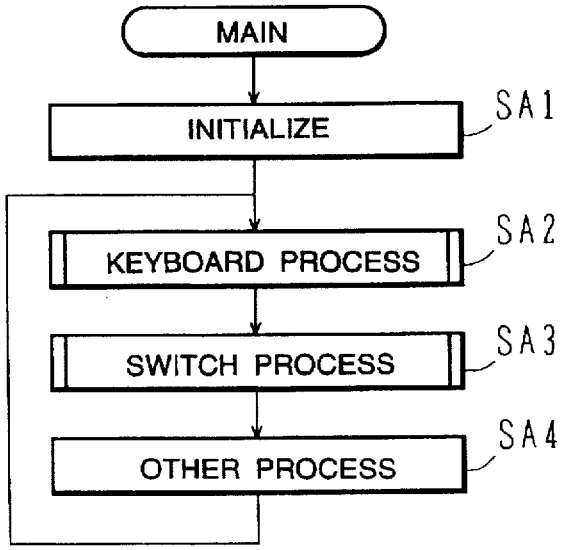
FIG. 6 is a flow chart explaining the main routine to be executed by CPU of the electronic musical instrument.

In the demonstration program selection state in Mode 1 after the completion of automatic performance in Mode 3, the demonstration program selection Mode 1 may be continued even if a registration switch is not depressed in a predetermined time. FIG. 6 is a flow chart explaining the main routine to be executed by CPU of the electronic musical instrument. When the power is turned on, initializing registers and the like is performed at Step SA1. A mode register MODE indicating the operating mode is set to "0" which is the manual performance mode.

At Step SA2, in accordance with the key manipulation on the keyboard 1 shown in FIG. 2 by a performer, a sound producing process is performed which will be later described with reference to FIG. 7. At Step SA3, in accordance with the state of various panel switches 3 shown in FIG. 2, the switch process is performed which will be later described with reference to FIG. 8. At Step SA4, other processes are performed such as an MIDI data transfer via the MIDI interface 12 shown in FIG. 2. After Step SA4, the flow returns to Step SA2 to repeat the above processes.

Figure 7:
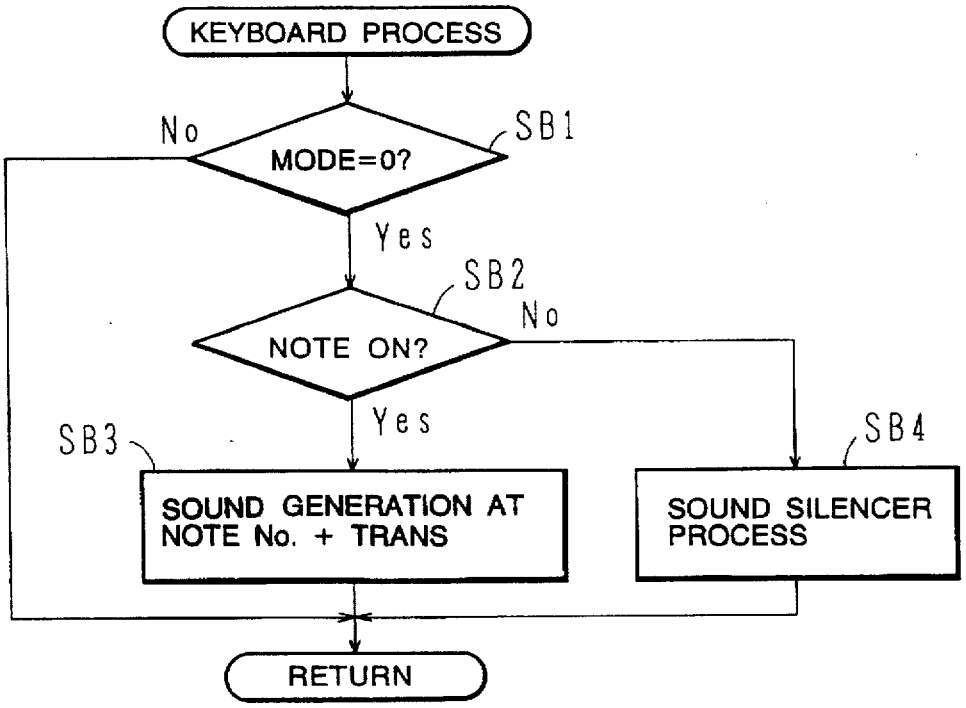
FIG. 7 is a flow chart explaining the details of the keyboard process to be executed at Step SA2 of FIG. 6.

FIG. 7 is a flow chart explaining the details of the keyboard process to be executed at Step SA2 of FIG. 6. The process starts from Step SB1.

At Step SB1, it is checked whether the mode register MODE is "0" or not. If not "0", it means that the operating mode is not the manual performance mode. The manual performance on the keyboard is not possible. Therefore, the keyboard process is terminated and the process returns to the main routine shown in FIG. 6.

If the mode register MODE is "0", the performer is allowed to play a program on the keyboard. At Step SB2 it is checked whether a key event detected from the keyboard is an on-note or not. If on-note, at Step SB3 the note number (pitch data) of the key detected with the on-note is added to the value in a musical key transposition register TRANS, and the resultant value is supplied to the sound source. The musical key transposition register TRANS stores the musical key transposition value set by the transposition switches 22 shown in FIG. 3. In accordance with the pitch data added with the musical key transposition value and supplied to the sound source, a sound is generated by the sound system. Thereafter, the flow returns to the main routine.

If the key event is not an on-note at Step SB2, it means an off-note so that at Step SB4 the sound generated by the sound system is silenced by a sound silencer process. Thereafter, the flow returns to the main routine.

Figure 8:
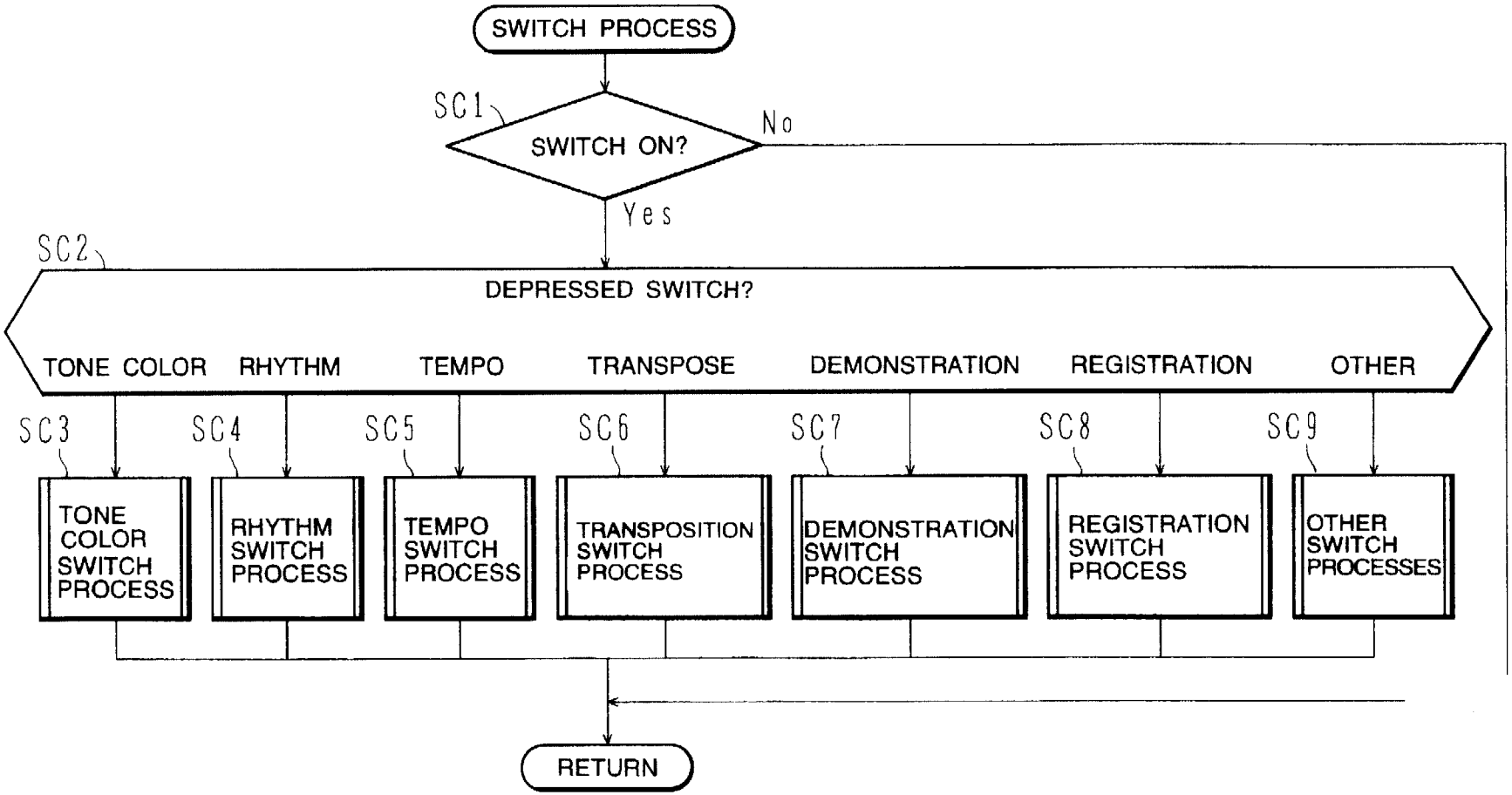
FIG. 8 is a flow chart explaining the details of the switch process to be executed at Step SA3 of FIG. 6.

FIG. 8 is a flow chart explaining the details of the switch process to be executed at Step SA3 of FIG. 6.

It is checked at Step SC1 whether any panel switch is ON. If not on, the switch process is terminated and the flow returns to the main routine shown in FIG. 6.

If there is any panel switch turned on, it is checked at Step SC2 what switch is ON. If a tone color switch is ON, a tone color process is performed at Step SC3. If a rhythm switch is ON, a rhythm switch process is performed at Step SC4. Similarly, if a tempo switch is depressed, a switch process at Step SC5 is performed, if a transposition switch is depressed, a switch process at Step SC6 is performed, if a demonstration switch is depressed, a switch process at Step SC7 is performed, and if a registration switch is depressed, a switch process at Step SC8 is performed. These switch processes will be later described.

If another switch not mentioned above is ON, a switch process at Step SC9 is performed. If a rhythm control switch is ON, a rhythm start/stop process is performed. If an effect switch is ON, the effects such as chorus, sustain, and reverberation are given. If a volume switch is manipulated, a volume control process is performed.

After the switch process is performed, the flow returns to the main routine of FIG. 6.

Figure 9:
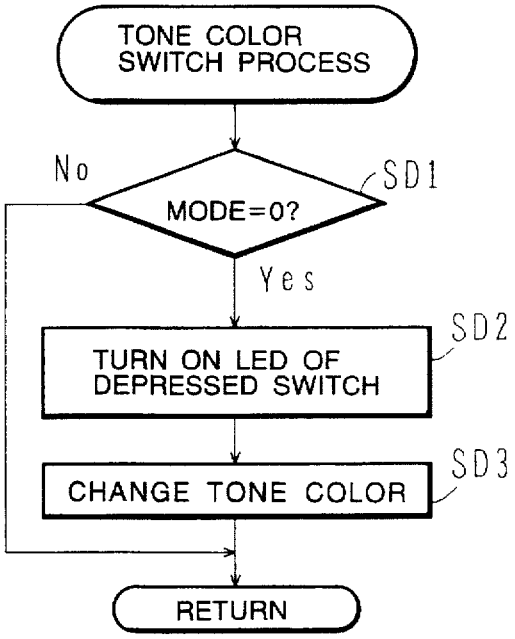
FIG. 9 is a flow chart explaining the details of the tone color switch process to be executed at Step SC3 of FIG. 6.

FIG. 9 is a flow chart explaining the details of the tone color switch process to be executed at Step SC3 of FIG. 8 When one of the tone color switches is depressed, the following process is performed.

It is checked at Step SD1 whether the mode register MODE is "0" or not. A tone color can be changed only when the operation mode is the manual performance mode. If the mode register MODE is "0", it means the manual performance mode, and at Step SD2 the LED for the previously set tone color is turned off and the LED for the newly set tone color is turned on. At Step SD3, the previously set tone color is changed to the newly set tone color. Thereafter, the flow returns to the main routine of FIG. 6. The performer can play a program at the changed tone color.

If the tone color is changed by the tone color switch, the LED of the registration switch is flashed to inform the performer of the color set different from the registration data.

If the mode register MODE is not "0" at Step SD1, the operating mode is not the manual performance mode. Therefore, the tone color is not changed and the flow returns to the main routine of FIG. 6.

Figure 10:
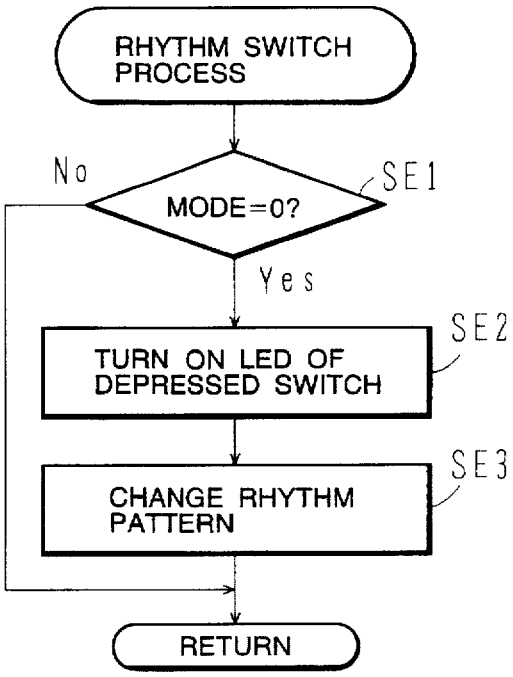
FIG. 10 is a flow chart explaining the details of the rhythm switch process to be executed at Step SC4 of FIG. 6.

FIG. 10 is a flow chart explaining the details of the rhythm switch process to be executed at Step SC4 of FIG. 8. When one of the rhythm switches is depressed, the following process is performed.

It is checked at Step SE1 whether the mode register MODE is "0" or not. A rhythm can be changed only when the operation mode is the manual performance mode. If the mode register MODE is "0", it means the manual performance mode, and at Step SE2 the LED for the previously set rhythm is turned off, the LED for the newly set rhythm is turned on, and the LED for the registration switch not turned on is flashed. At Step SE3, the previously set rhythm is changed to the newly set rhythm. Thereafter, the flow returns to the main routine of FIG. 6. The performer can play a program at the changed rhythm. If the tone color is changed by the tone color switch, the LED of the registration switch is flashed to inform the performer of the color set different from the registration data.

If the mode register MODE is not "0" at Step SE1, the operating mode is not the manual performance mode. Therefore, the rhythm pattern is not changed and the flow returns to the main routine of FIG. 6.

Figure 11:
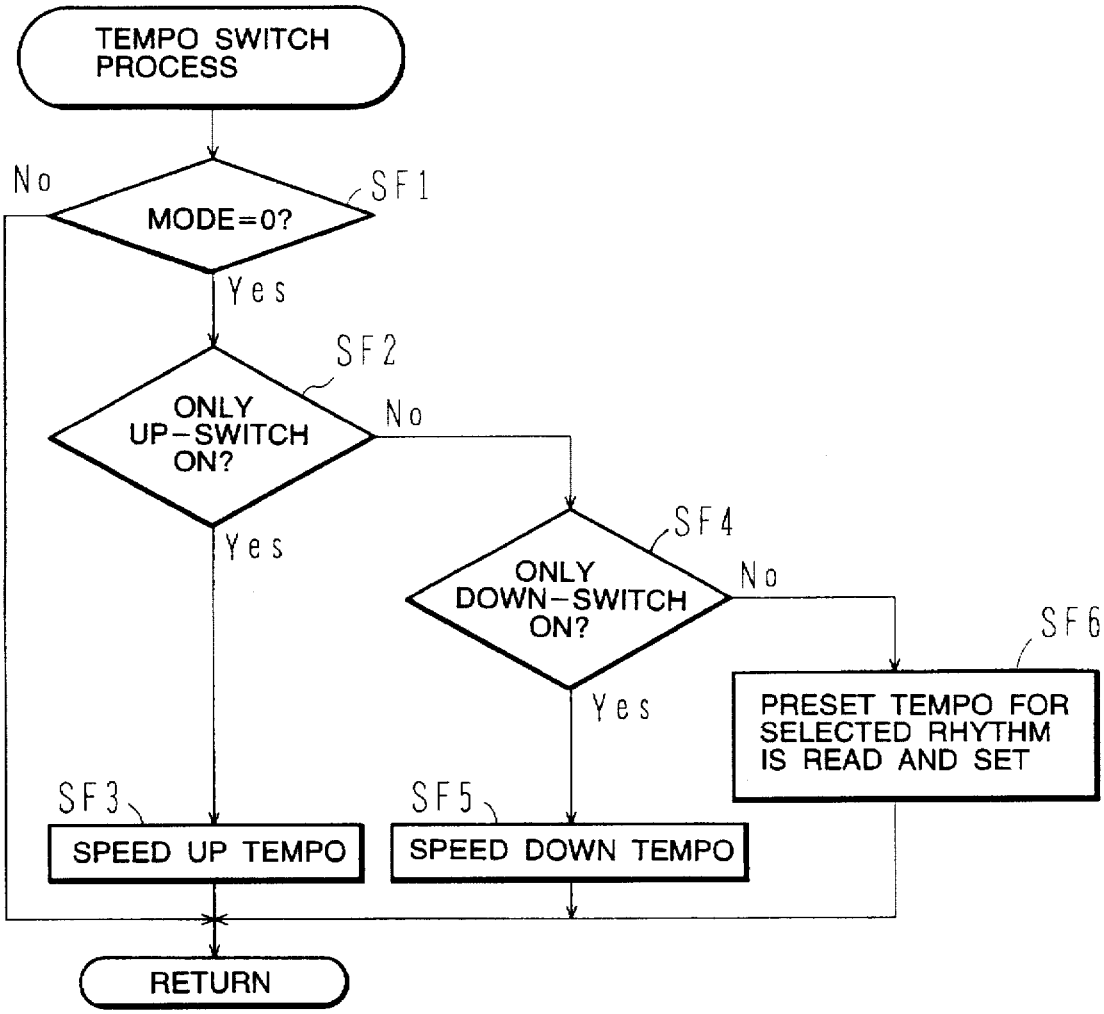
FIG. 11 is a flow chart explaining the details of the tempo switch process to be executed at Step SC5 of FIG. 6.

FIG. 11 is a flow chart explaining the details of the tempo switch process to be executed at Step SC5 of FIG. 8. When an up-switch or a down-switch for instruction speed-up or speed-down of the tempo is depressed, the following process is performed.

It is checked at Step SF1 whether the mode register MODE is "0" or not. A tempo can be changed only when the operation mode is the manual performance mode. If the mode register MODE is "0", it means the manual performance mode, and at Step SF2 it is checked whether only the up-switch is ON. If the up-switch only is not ON, at Step SF4 it is checked whether only the down-switch is ON.

Of the up- and down-switches, if the up-switch only is ON, at Step SF3 the tempo is speeded up. If the down-switch only is ON, at Step SF5 the tempo is speeded down. If both the up- and down-switches are ON, at Step SF6 one of the rhythm pattern data RD1 to RD8 shown in FIG. 1C and stored in ROM which is suitable for the presently selected rhythm is read and stored. In this manner, not with the tempo suitable for the musical style corresponding to the registration switch, but with the tempo suitable for the rhythm is set. Thereafter, the flow returns to the main routine of FIG. 6.

Figure 12:
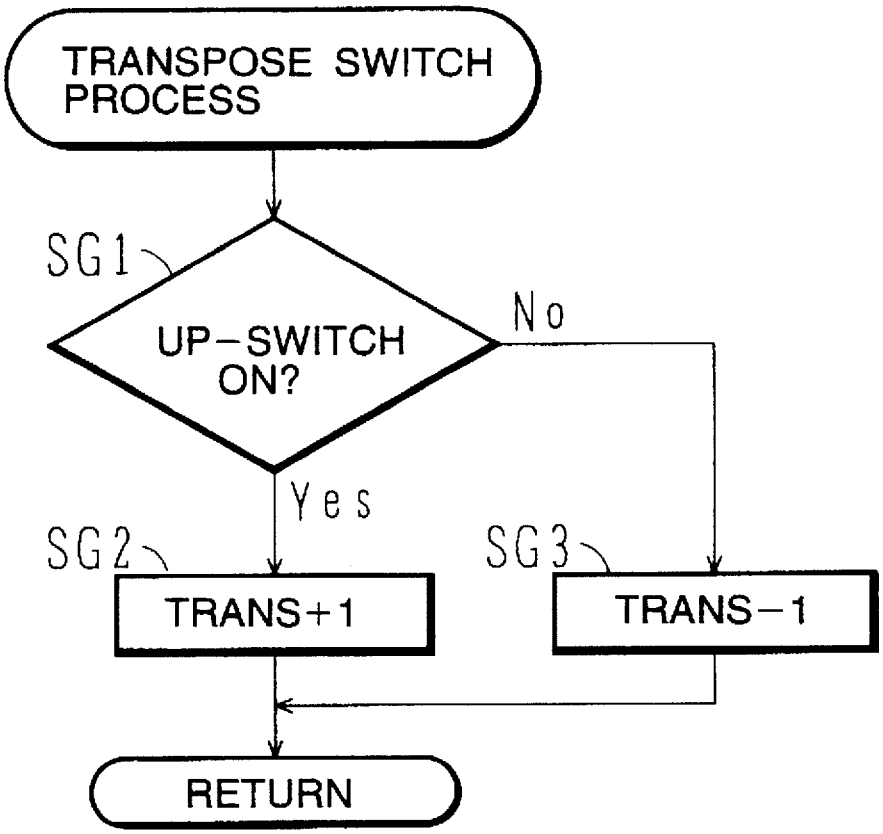
FIG. 12 is a flow chart explaining the details of the transposition switch process to be executed at Step SC6 of FIG. 6.

FIG. 12 is a flow chart explaining the details of the transposition switch process to be executed at Step SC6 of FIG. 8. When an up-switch or a down-switch for instruction musical key up-transposition or down-transposition is selected, the following process is performed. The musical key transposition can be independently set between the manual performance mode and demonstration program automatic performance mode.

It is checked at Step SG1 whether only the up-switch is ON. If the up-switch is ON, at Step SG2 the value in the musical key transposition register TRANS is incremented to raise the musical key by a semitone. If the up-switch is not ON and the down-switch is ON, at Step SF3 the value in he musical key transposition register TRANS is decremented by lower the musical key by a semitone. Thereafter, the flow returns to the main routine of FIG. 6.

Figure 13:
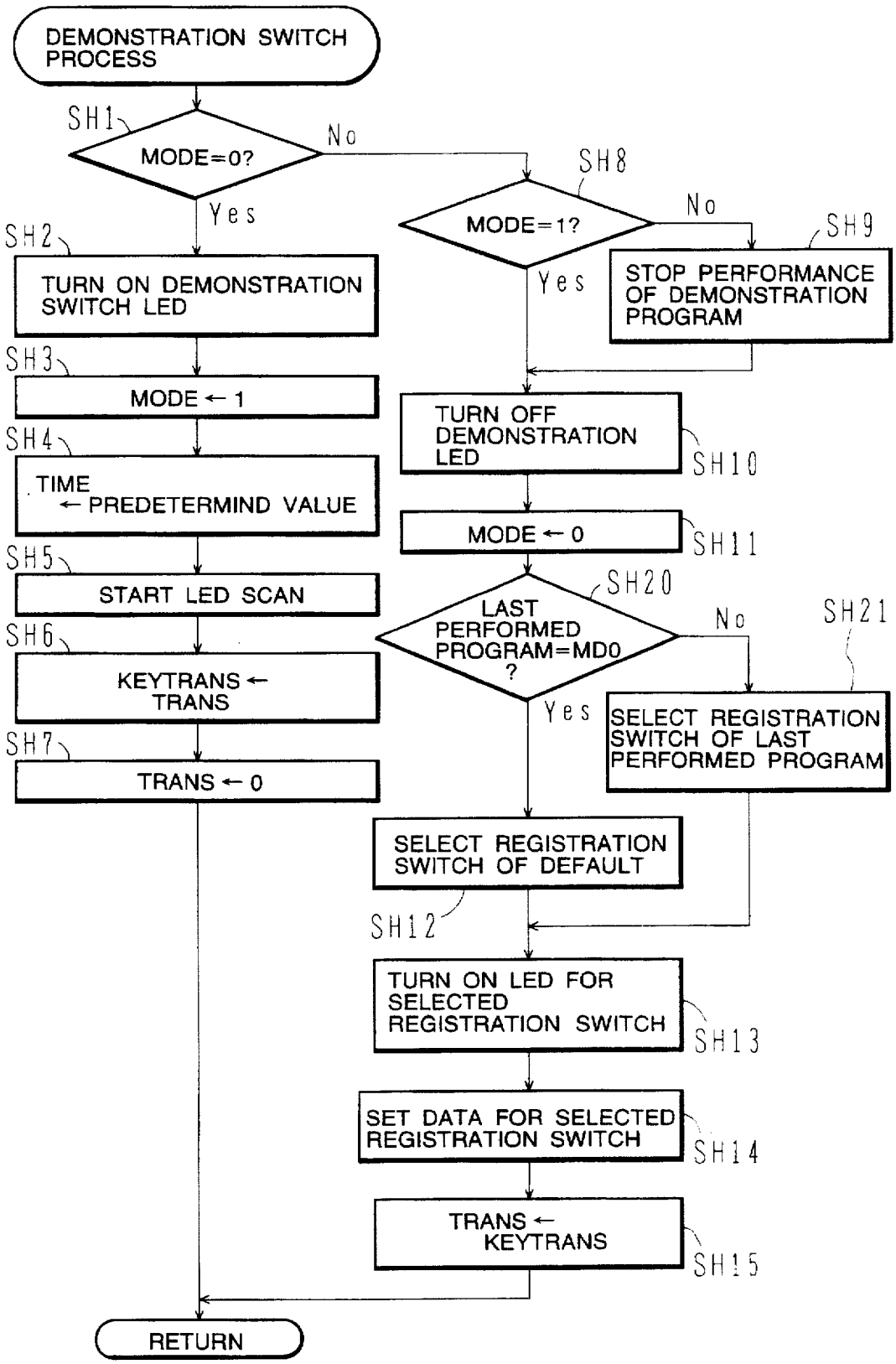
FIG. 13 is a flow chart explaining the details of the demonstration switch process to be executed at Step SC7 of FIG. 6.

FIG. 13 is a flow chart explaining the details of the demonstration switch process to be executed at Step SC7 of FIG. 8. When one of the demonstration switches is depressed, the following process is performed.

It is checked at Step SH1 whether the mode register MODE is "0" or not. If the mode register MODE is "0", it means the manual performance mode, and at Step SH2 the LED for the depressed demonstration switch is turned on to inform the performer a transition of the operating mode from Mode 0 to Mode 1. The LED for the demonstration switch is turned off in the manual performance Mode 0, whereas it is turned on in the demonstration program selection Mode 1.

At Step SH3, "1" is set to the mode register MODE to establish the state of Mode 1. At Step SH4, a predetermined value is set to the timer register TIME. For example, if "30" is set to the timer register TIME, the selection of a demonstration program is allowed for 3 seconds. The value of the timer register TIME is decremented each 100 ms by the timer interrupt process to be later described. Therefore, if "30" is set to the timer register TIME, the value of the timer register TIME becomes "0" in 3 seconds.

At Step SH5 the eight LEDs of the registration switches are sequentially scanned and turned on. Scanning the LEDs informs the performer of the demonstration selection state.

At Step SH6 the value in the musical key transposition register TRANS is saved in a musical key transposition save register KEYTRANS to temporarily save the musical key transposition value set in the manual performance mode. Thereafter, the automatic performance mode of a demonstration program starts. The saved musical key transposition value is read again when the manual performance mode is resumed.

At Step SH7 the musical key transposition register TRANS is reset to "0" to clear the previously set musical key transposition value in the automatic performance mode. The musical key transposition in the automatic performance mode can be set separately and independently from that in the manual performance mode. Thereafter, the flow returns to the main routine of FIG. 6.

If it is judged at Step SH1 that the mode register MODE is not "0", it means that the demonstration was depressed again after the automatic performance mode was entered once. In this case, at Step SH8 it is checked whether the mode register MODE is "1" or not. If not "1", it means that the operation mode is the automatic performance Mode 2 or 3, and at Step SH9 the automatic performance of the demonstration program is stopped to follow Step SH10. If the mode register MODE is "1", the flow directly advances to Step SH10.

At Step SH10, the LED for the demonstration switch is turned off, and at Step SH11 the mode register MODE is set with "0" to transfer to the manual performance mode. In any one of Modes 1 to 3, the operating mode transits to Mode 0 when the demonstration switch is depressed.

At Step SH20, it is checked whether the demonstration program last performed prior to depressing the demonstration switch is MD0 or not. If not, at Step SH21 the registration switch corresponding to the demonstration program last performed is selected.

If the last performed demonstration program is MD0, there is no corresponding registration switch, and at Step SH12 a default registration switch is selected. This default state may be the state of the panel switches initially set when the power of the electronic musical instrument is turned on.

At Step SH13, the LED for the selected registration switch is turned on. At Step SH14 the settings for the selected registration switch are established.

At Step SH15 the value in the musical key transposition save register KEYTRANS is returned to the musical key transposition register TRANS to recover the musical key transposition value saved when the manual performance mode transits to the automatic performance mode. Thereafter, the flow returns to the main routine of FIG. 6.

Figure 14:
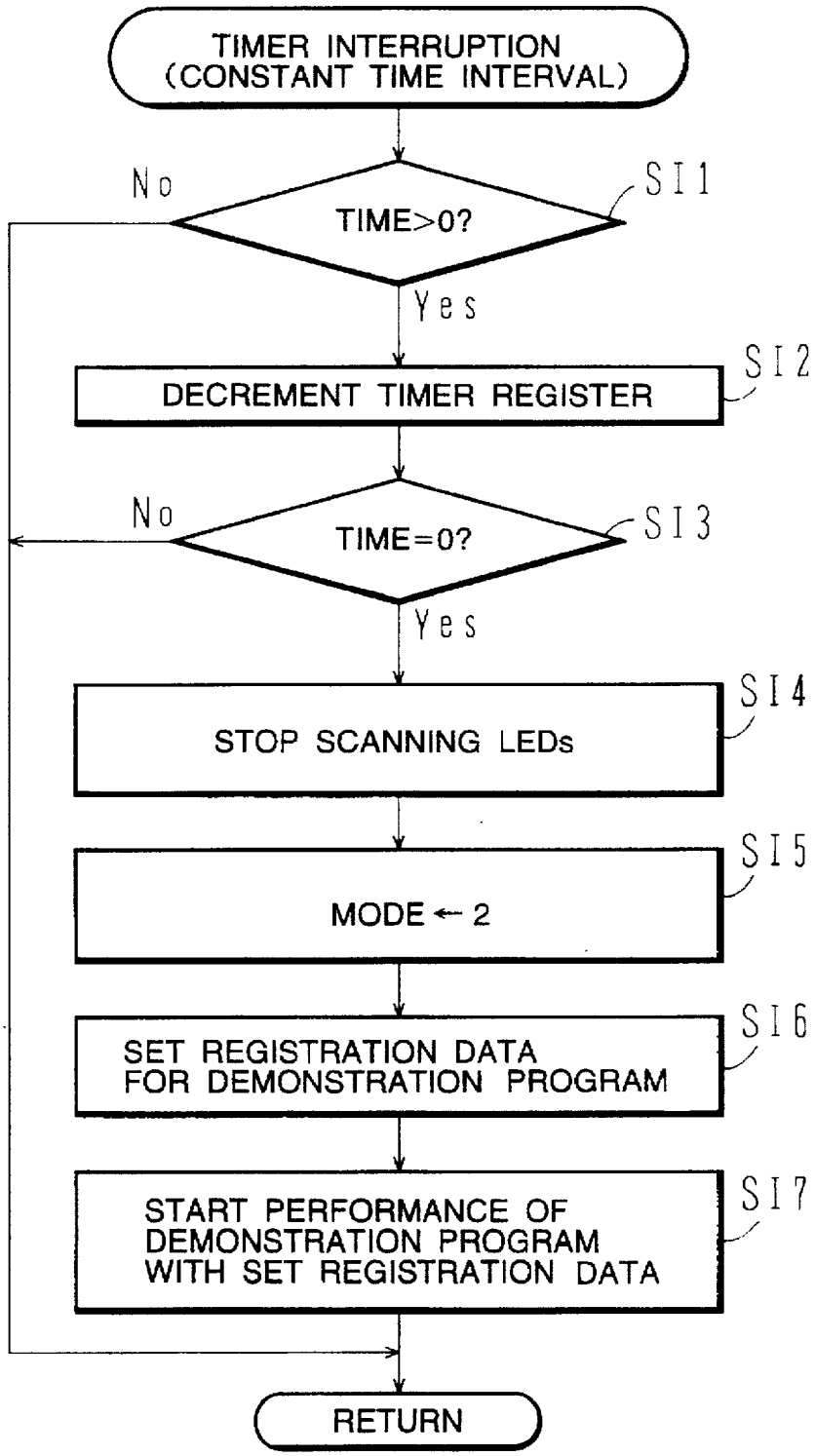
FIG. 14 is a flow chart explaining a timer interrupt process by a timer register TIME.

FIG. 14 is a flow chart explaining the timer interrupt process to be executed by the timer register TIME. The timer 11 shown in FIG. 2 supplies an interrupt signal to CPU 10 at a constant time interval. Each time an interrupt signal is received, CPU performs the following process. The timer 11 supplies the interrupt signal, for example, at a 100 ms interval.

At Step S11 it is checked whether the timer register TIME is larger than "0". If not larger, the timer is not operating so that the flow returns to the original process.

If the timer register TIME is larger than "0", at Step S12 the value of the timer register TIME is decremented. At Step S13 it is checked whether the value of the decremented timer register TIME is "0". If not, it means a predetermined time (e.g. 3 seconds) has not lapsed as yet and the flow returns to the original process. If the timer register TIME is "0", it means a lapse of the predetermined time and the flow advances to Step S14.

At Step S14, scanning the LEDs of the registration switches is stopped to inform the performer of the end of the demonstration selection state. At Step S15, the mode register MODE is set to "2" to enter the all demonstration program performance mode. In other words, if no registration switch is depressed in the predetermined time after Mode 1 starts, the operating mode transits to Mode 2.

At Step S16 the registration data GD0 is set for the demonstration program to be first performed among all the demonstration programs. At Step S17 the demonstration program automatic performance data MD0 corresponding to the registration data GD0 is read and the automatic performance starts. Thereafter, the flow returns to the process executed prior to the interrupt process.

Figure 15:
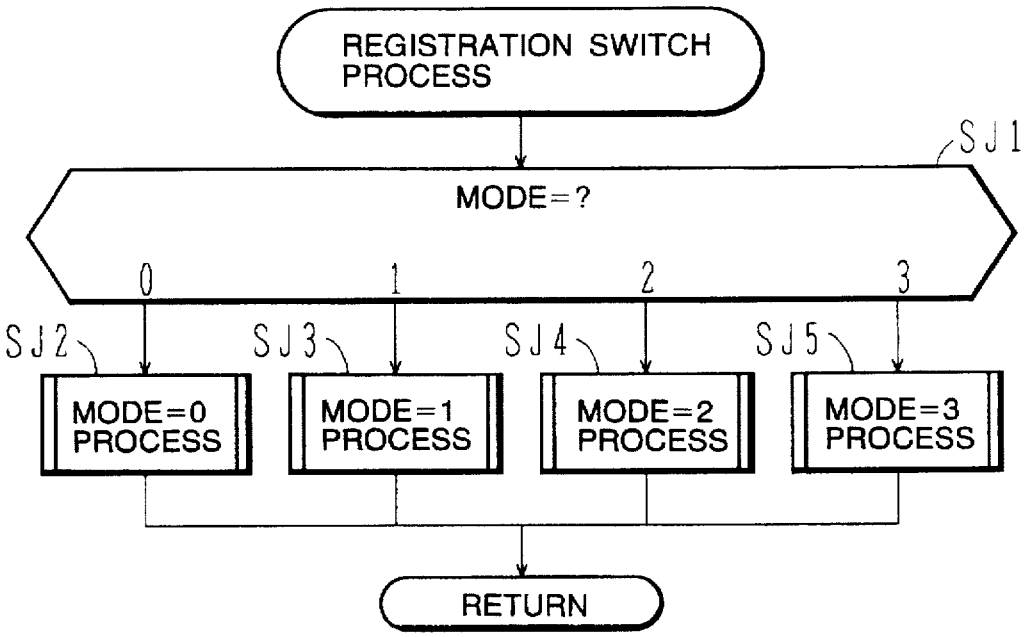
FIG. 15 is a flow chart explaining the details of the registration switch process to be executed at Step SC8 of FIG. 6.

FIG. 15 is a flow chart explaining the details of the registration switch process to be executed at Step SC8 of FIG. 8 When one of the registration switches 16 shown in FIG. 3 is depressed, the following process is performed.

At Step SJ1 the value of the mode register MODE is checked. If "0", a MODE=0 process is performed at Step SJ2. If "1", a MODE=1 process is performed at Step SJ3, if "2", a MODE=2 process is performed at Step SJ4, and if "3", a MODE=3 process is performed at Step SJ5. Thereafter, the flow returns to the main routine of FIG. 6.

Next, the detailed processes to be performed when a registration switch is depressed will be described for each Mode.

Figure 16:
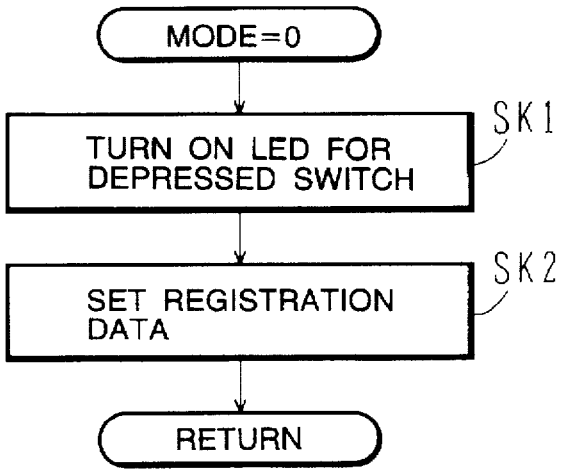
FIG. 16 is a flow chart explaining the details of the MODE=0 process to be executed at Step SJ2 of FIG. 15.

FIG. 16 is a flow chart explaining the details of the MODE=0 process to be executed at Step SJ2 of FIG. 15. The following process is performed when a registration key is depressed in Mode 0.

At Step SK1, the LED of the depressed registration switch is turned on. At Step SK2 the registration data for the depressed registration switch is set. Setting the registration data means setting a predetermined tone color, rhythm, and the like. Simultaneously with setting the tone color, rhythm, and the like, the LEDs of the corresponding tone color switch, rhythm switch, and other switches are turned on. Thereafter, the flow returns to the main routine of FIG. 6.

As above, when a registration switch is depressed in the manual performance Mode 0, new registration data is set and the musical style of a program to be performed is changed.

Figure 17:
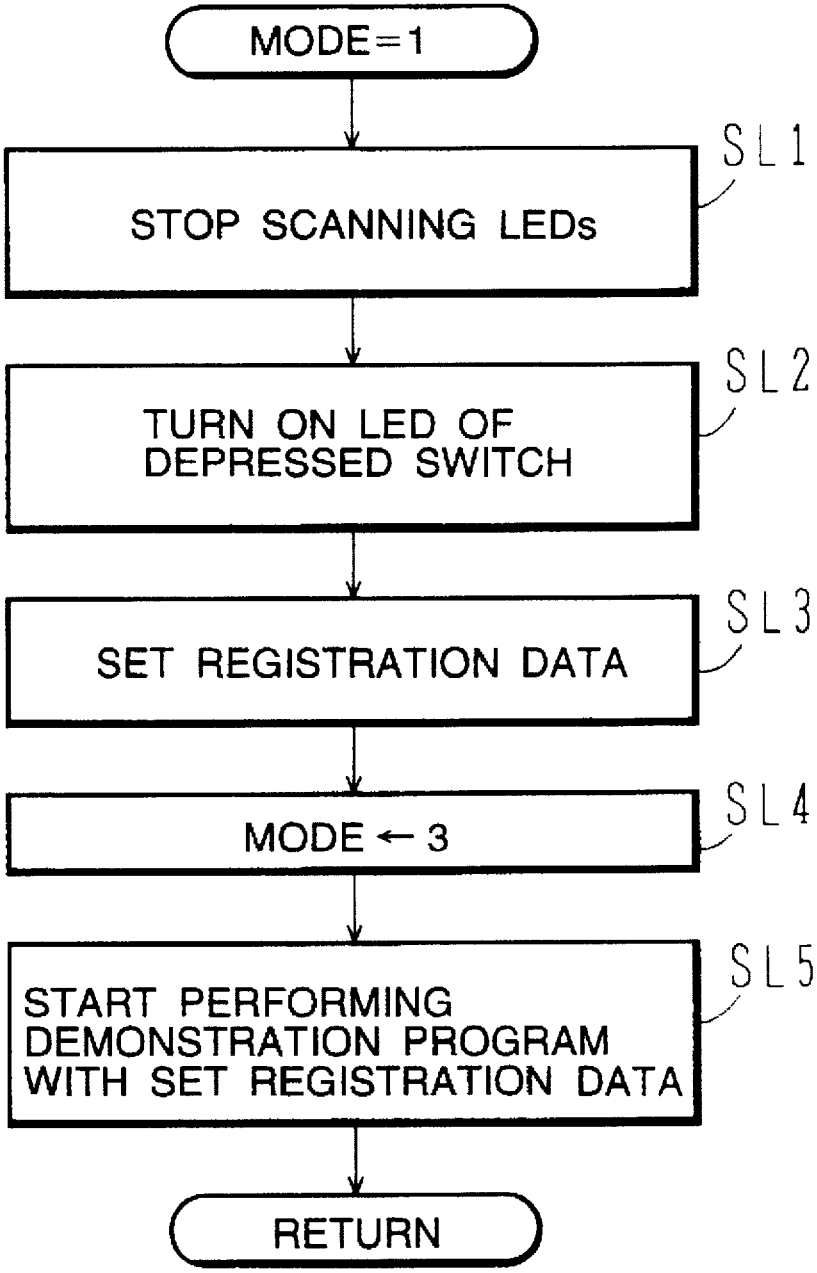
FIG. 17 is a flow chart explaining the details of the MODE=1 process to be executed at Step SJ3 of FIG. 15.

FIG. 17 is a flow chart explaining the details of the MODE=1 process to be executed at Step SJ3 of FIG. 15. The following process is performed when a registration key is depressed in the demonstration program selection Mode 1.

At Step SL1, scanning the LEDs of the registration switches is stopped to inform the performer of the end of the demonstration selection state. At Step SL2, the LED of the depressed registration switch is turned on. At Step SL3, the registration data for the depressed registration switch is set. Setting the registration data means setting a predetermined tone color, rhythm, and the like and at the same time turning on the LEDs of the corresponding tone color switch, rhythm switch, and the like.

At Step SL4, the mode register MODE is set to "3" to transit from Mode 1 to Mode 3 which is the signal demonstration program automatic performance mode. At Step SL5, the demonstration program performance data for the set registration data is read to start the automatic performance. Thereafter, the flow returns to the main routine of FIG. 6.

As above, when a registration switch is depressed in the demonstration program selection Mode 1, the operating mode transits to Mode 3 and the demonstration program having a musical style corresponding to the depressed switch is performed. If any registration switch is not depressed in a predetermined time (e.g., 3 seconds), the operating mode transits to Mode 2 in which the demonstration programs MD0 to MD8 are sequentially and automatically performed.

In Mode 2 and Mode 3, a demonstration program having a musical style selected by the registration switch is automatically performed. Thereafter, the automatic performance continues under the following timer interrupt process.

Figure 18:
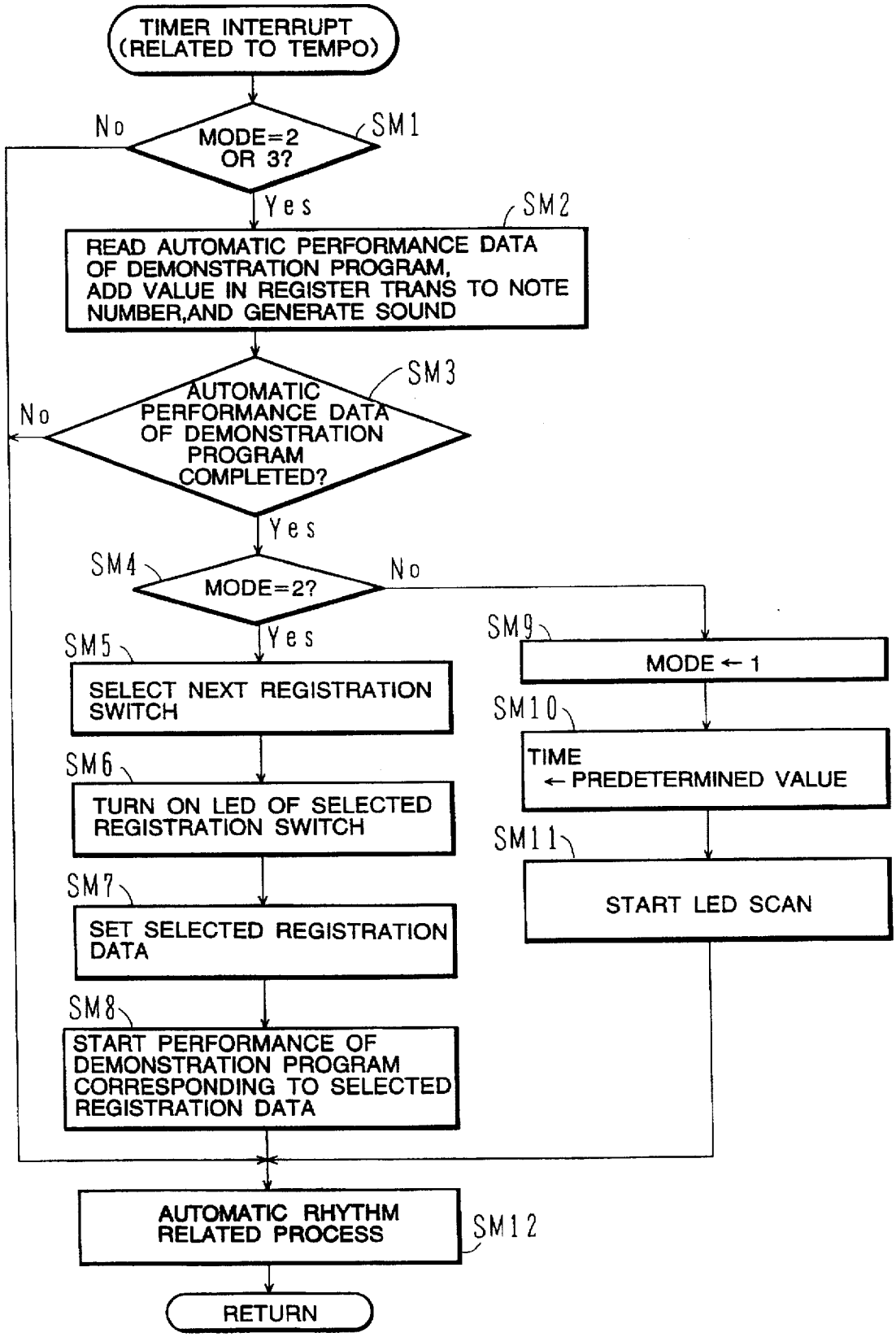
FIG. 18 is a flow chart explaining an interrupt process for automatic performance.

FIG. 18 is a flow chart explaining a timer interrupt process for the automatic performance. CPU 10 shown in FIG. 2 executes this timer interrupt process at a time interval corresponding to the tempo speed set by registration data.

At Step SM1 it is checked whether the mode register MODE is "2" or "3". If not Mode 2 and Mode 3, the automatic performance is not effected, but at Step SM12 an automatic accompaniment performance starts in accordance with the set rhythm data. Thereafter, the process executed prior to the interrupt process resumes.

If the operating mode is Mode 2 or Mode 3 at Step SM2, the automatic performance process starts at SM2 wherein the automatic performance data of a demonstration program is read from ROM, and the read note number (pitch data) is added to the value in the musical key transposition register TRANS. The added pitch value is supplied to the sound source and the sound system generates the corresponding sound.

It is checked at Step SM3 whether the automatic performance data of the demonstration program has been completed. If not, the demonstration program is under performance, and at Step SM12 the automatic accompaniment is performed in accordance with the presently set rhythm data. Thereafter, the process executed prior to the interruption process resumes.

If the automatic performance data of the demonstration program has been completed at Step SM3, the flow advances to Step SM4.

At Step SM4 it is checked whether the operating mode is Mode 2. If Mode 2, the demonstration programs are repetitively and automatically performed. Therefore, at Step SM5, the registration data of the program next to the already performed program is selected. The demonstration programs are repetitively designated in the order of MD0, MD1, MD2, . . . , MD8, MD1, MD2, . . . . The registration switches on the panel are selected in the order from the upper left to the lower right. It is not necessary to set the same selection pattern in the order from the upper left to the lower right, but the next registration switch may be selected at random.

At Step SM6 the LED of the selected registration switch is turned on. At Step SM7 the registration data of the selected switch is set. At Step SM8 the automatic performance data of the demonstration program corresponding to the selected demonstration switch is read to start automatic performance. Thereafter, at Step SM12 the automatic accompaniment is performed in accordance with the presently set rhythm data, and then the process executed prior to the interrupt process resumes.

If the operating mode is not Mode 2 at Step SM4, then the operating mode is Mode 3. Therefore, at Step SM9, "1" is set to the mode register MODE so that one demonstration program is performed in Mode 3 and the operating mode transits to Mode 1. At Step SM10 a predetermined value (e.g., 30) is set to the timer register TIME and the timer count starts. At Step SM11 the LEDs of the registration switches start being scanned to inform the performer of the demonstration program selection state. Thereafter, at Step SM12 an automatic accompaniment is performed in accordance with the presently set rhythm data, and the process executed prior to the interrupt process resumes.

Figure 19:
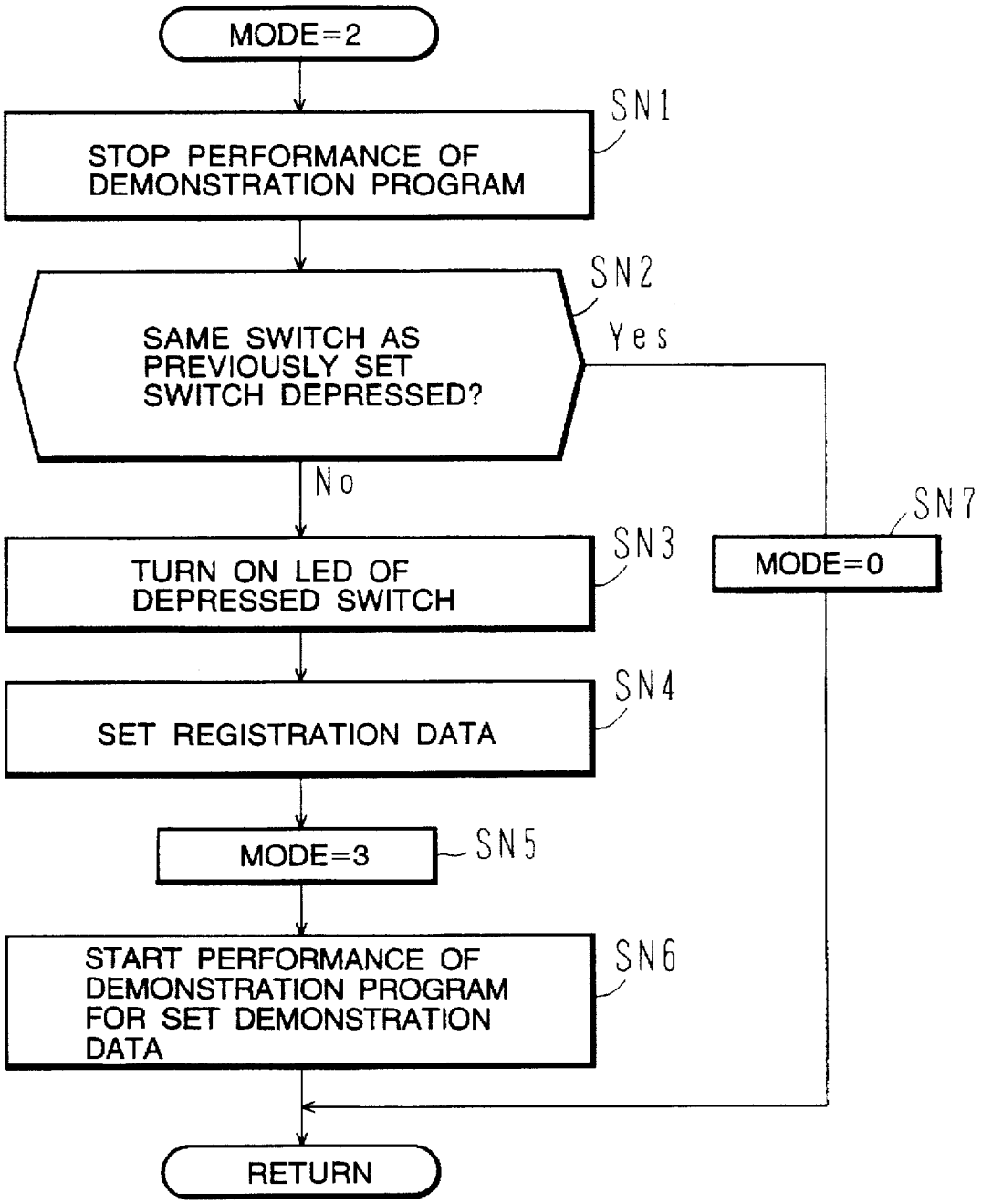
FIG. 19 is a flow chart explaining the details of the MODE=2 process to be executed at Step SJ4 of FIG. 15.

FIG. 19 is a flow chart explaining the details of the MODE=2 process to be executed at Step SJ4 of FIG. 15. The following process is performed when a registration key is depressed while all the demonstration programs are sequentially and automatically performed in Mode 2.

At Step SN1 the automatic performance of a demonstration program is stopped.

At Step SN2 it is checked whether the same registration switch as the previously performed demonstration program with the presently turned-on LED has been depressed. If the same registration switch, at Step SN7 "0" is set to the mode register MODE to transit to the manual performance mode. Thereafter, the flow returns to the main routine of FIG. 6.

If a different registration switch is depressed, at Step SN3 the LED of the previously set registration switch is turned off and the LED of the newly set registration switch is turned on. At Step SN4 the registration data for the depressed switch is set, and at the same time when a predetermined tone color, rhythm, and the like are set, the LEDs of the corresponding tone color switch, rhythm switch, and the like are turned on. At Step SN5 "3" is set to the mode register MODE to transit to the single demonstration program automatic performance mode. At Step SN6 the automatic performance data of the demonstration program with the set registration data is read from ROM to start the automatic performance. Thereafter, the flow returns to the main routine of FIG. 6.

As above, in the all demonstration program performance Mode 2, the demonstration program having the musical style corresponding to the registration switch with the turned-on LED is automatically performed. When the same registration switch with the turned-on LED is depressed, the operating mode transits to Mode 0 allowing the manual performance. When a registration switch with a turned-off LED is depressed, the operating mode transits to Mode 3 to automatically perform the demonstration program at the musical style corresponding to the depressed switch.

Figure 20:
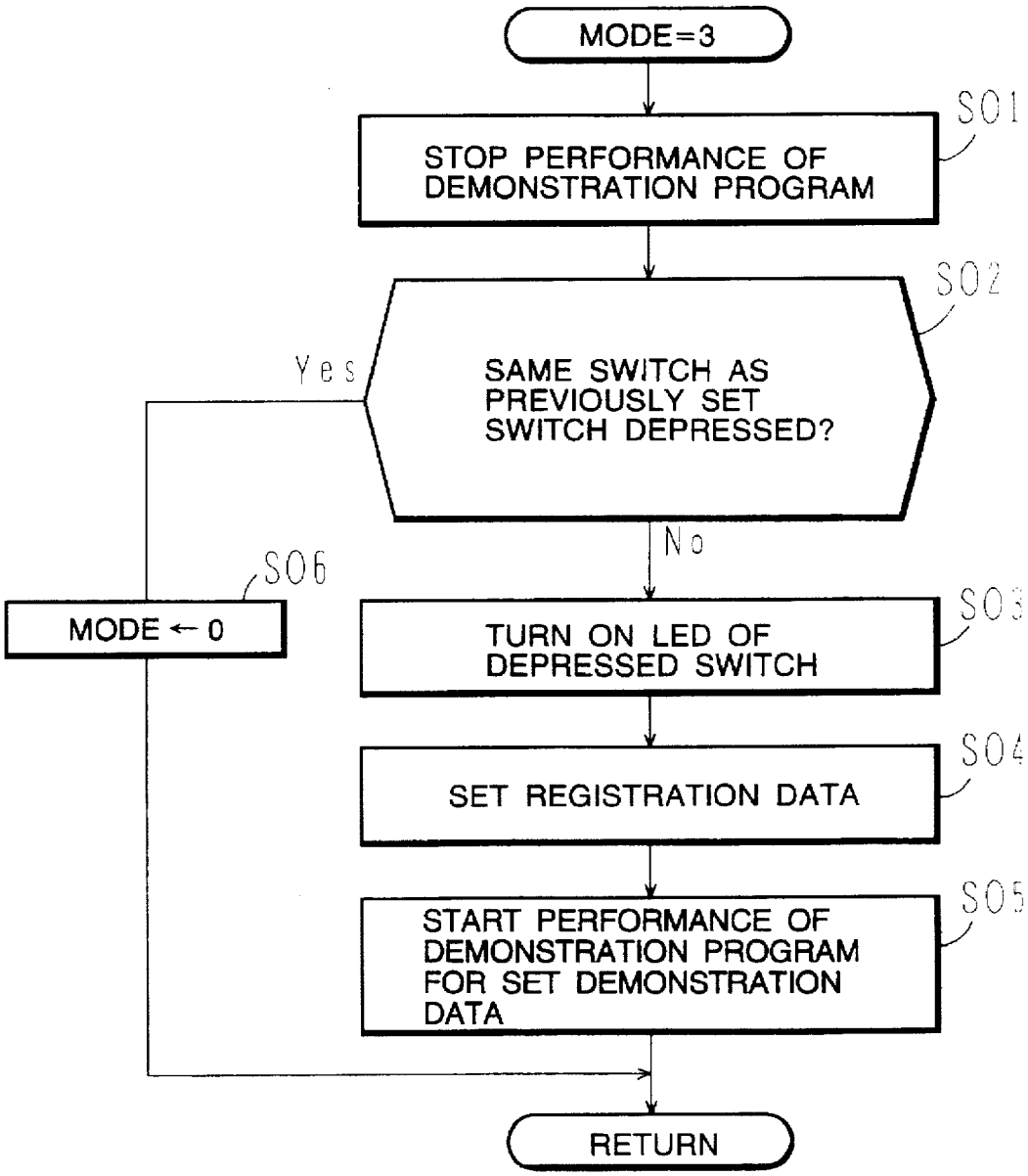
FIG. 20 is a flow chart explaining the details of the MODE=3 process to be executed at Step SJ5 of FIG. 15.

FIG. 20 is a flow chart explaining the details of the MODE=3 process to be executed at Step SJ5 of FIG. 15. The following process is performed when a registration key is depressed while a single demonstration programs is automatically performed in Mode 3.

At Step S01 the automatic performance of a demonstration program is stopped.

At Step S02 it is checked whether the same registration switch as the previously performed demonstration program with the presently turned-on LED has been depressed. If the same registration switch, at Step S06 "0" is set to the mode register MODE to transit to the manual performance mode. Thereafter, the flow returns to the main routine of FIG. 6.

If a different registration switch is depressed, at Step S03 the LED of the previously set registration switch is turned off and the LED of the newly set registration switch is turned on. At Step S04 the registration data for the depressed switch is set, and at the same time when a predetermined tone color, rhythm, and the like are set, the LEDs of the corresponding tone color switch, rhythm switch, and the like are turned on. At Step S05 the automatic performance data of the demonstration program with the set registration data is read from ROM to start the automatic performance thereof in the same operating mode. Thereafter, the flow returns to the main routine of FIG. 6.

As above, in the single demonstration program performance Mode 3, the LED of the depressed registration switch is turned on, and the demonstration program having the musical style corresponding to the depressed registration switch is automatically performed. When the same registration switch with the turned-on LED is depressed, the operating mode transits to Mode 0 allowing the manual performance. When a registration switch with a turned-off LED is depressed, the operating mode is not changed, but the demonstration program at the musical style corresponding to the depressed switch is automatically performed in the same Mode 3.

In the above embodiment, if a performer in the manual performance mode wishes to listen a demonstration program as a training program, the performer is required to transit to the automatic performance mode by depressing both the demonstration switch and registration switch. Specifically, if a performer in the manual performance mode wishes to listen a demonstration program, the performer is required to depress the demonstration switch to transit to the demonstration program selection state (Mode 1) and thereafter to depress the registration switch corresponding to the demonstration program. In this manner, the demonstration program with the selected musical style can be automatically performed. The following is an example of the process allowing a performer to transit from the manual performance mode to the automatic performance mode by depressing a registration switch only once.

Figure 21:
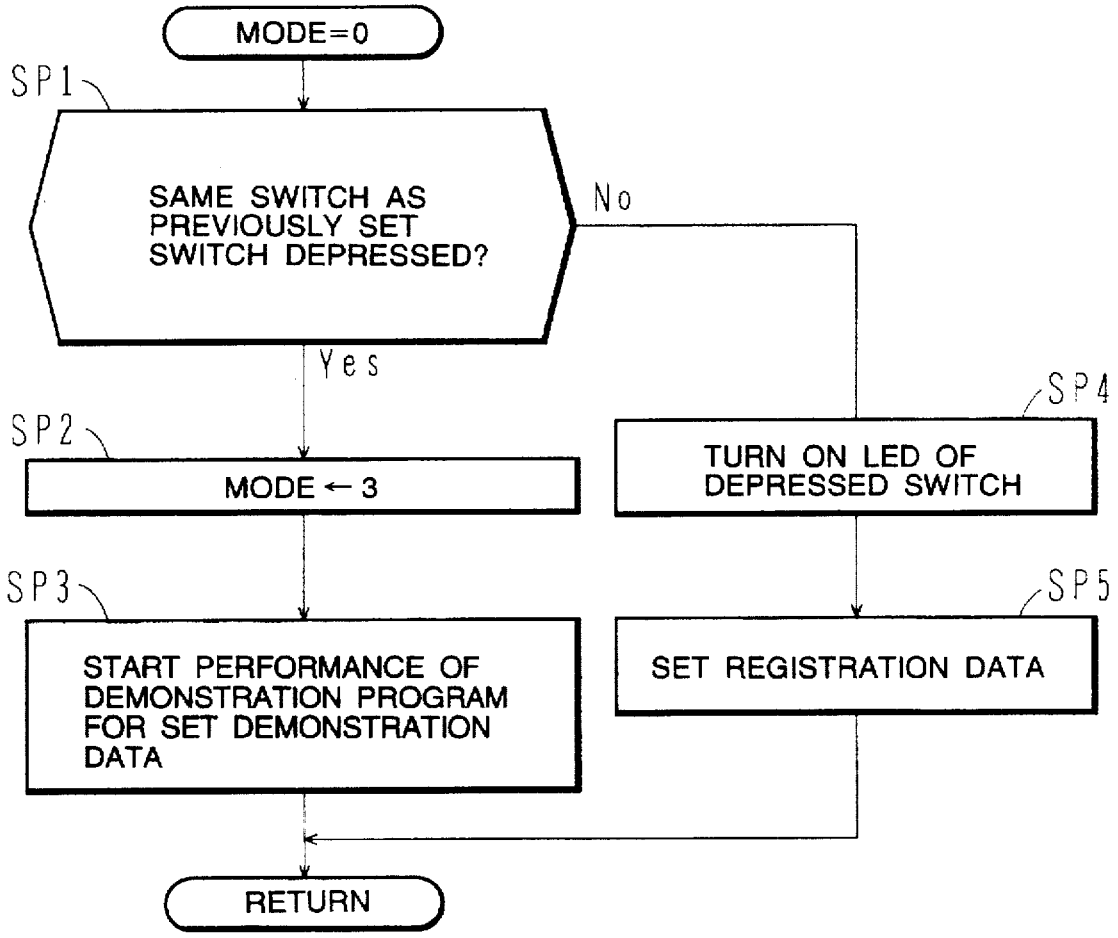
FIG. 21 is a flow chart explaining the process to be executed as a substitute for the MODE=0 process illustrated in FIG. 16.

FIG. 21 is a flow chart explaining an alternate for the MODE=0 process shown in FIG. 16. The following process is performed when a registration switch is depressed during the manual performance Mode 1.

At Step SP1 it is checked whether the same registration switch as the presently depressed registration switch with the turned-on LED is depressed. If the same registration switch, at Step SP2 "3" is set to the mode register MODE to transit to the demonstration program automatic performance mode. At Step SP3 the demonstration program is automatically performed at the same musical style as the program trained in the manual performance mode prior to the operating mode transition. Thereafter, the flow returns to the main routine of FIG. 6.

If a different registration switch is depressed, at Step SP4 the LED of the previously set registration switch is turned off and the LED of the newly set registration switch is turned on. At Step SP5 the registration data for the depressed switch is set, and at the same time when a predetermined tone color, rhythm, and the like are set, the LEDs of the corresponding tone color switch, rhythm switch, and the like are turned on. Thereafter, the flow returns to the main routine of FIG. 6.

When the registration switch with the turned-on LED is depressed during the period while the demonstration program corresponding to the switch is trained, it is possible to listen the demonstration program at the same musical style. If the same registration switch is again depressed in this state, the manual performance of the demonstration is possible. In this state, if the same registration switch is again depressed, the automatic performance of the demonstration program may be resumed starting from the intercepted program portion or from the start of the program.

As described so far, when a performer selects a desired musical style by depressing one of the registration switches, the tone color, rhythm, effect, volume, and the like most suitable for the musical style can be set at once. Furthermore, each demonstration program for the automatic performance is assigned with registration data and given a musical style most suitable for the program and for the performance atmosphere recommended by the maker. Therefore, each demonstration program can be automatically performed under the best conditions.

It is also possible to set the performance atmosphere by depressing a registration switch only once, if the performer wishes to train the demonstration program.

The registration data of each musical type includes a preset tempo. A manual performance at a tempo the maker recommends for each musical style is therefore possible, and the musical style can be effectively mastered.

The preset tempo of the registration data is set suitable for a combination of tone color, rhythm, and the like. Instead, the preset tempo may be set most suitable mainly for the rhythm, allowing a manual performance at a tempo suitable mainly for the rhythm.

A musical key transposition can be set independently between the manual performance and automatic performance. The musical key transposition value set in the manual performance mode is reset in the automatic performance mode. Therefore, the automatic performance at a desired musical key matching the musical style becomes possible. A desired musical key transposition value can be set in the automatic performance mode. If the operating mode returns to the manual performance mode, the previously set transposition value is read and set again so that the degree of freedom of the musical key transposition function is broadened.

In the above embodiment, the musical key transposition value is reset to "0" when the manual performance mode transits to the automatic performance mode. The transition value in the automatic performance mode may be stored and used in the manual performance mode. If the transposition value is stored for each demonstration program, a performer can use the stored transition value so that the training of a demonstration can be effectively made.

Keys may be pointed out, for example, by providing a lamp to each key of the keyboard, in the demonstration program automatic performance, in order to help a performer train the demonstration program performance.

Next, an automatic performance function of another embodiment will be described.

FIGS. 22A to 22D show the formats of main data stored in ROM.

Figure 22A:
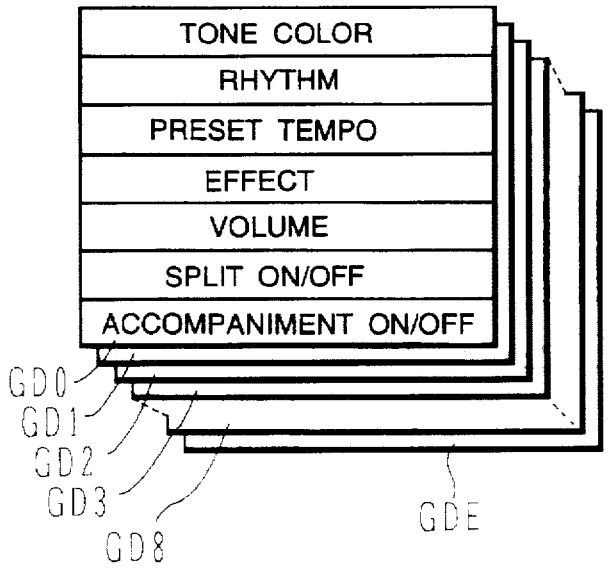
FIGS. 22A to 22D show other examples of main formats of data stored in ROM.

FIG. 22A shows the format of registration data including registration data GD0 to GD8 similar to those described above and registration data GDE for an ending program. The registration data GD0 to GD8 correspond to the registration switches on the panel. The opening data GD0 and ending data GDE are set when an opening program MD0 and an ending program MDE are automatically performed. Each registration data GD has the format constituted by a tone color, rhythm, preset tempo, effect, volume, split on/off, and accompaniment on/off.

Figure 22B:
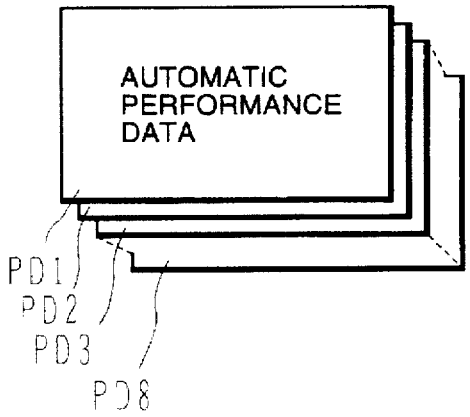

FIG. 22B shows the data format of automatic performance data of each demonstration program. In addition to the performance data MD0 to MD8, the performance data MDE for the ending program is provided. The automatic performance data MD1 to MD8 are for the demonstration programs each having a musical style corresponding to each registration switch. In the all demonstration program performance Mode 2, the performance data MD0 for the opening program is first used, and the performance data MD1 to MD8 are sequentially used for the automatic performance, and lastly the performance data MDE for the ending program is used.

Figure 22C:
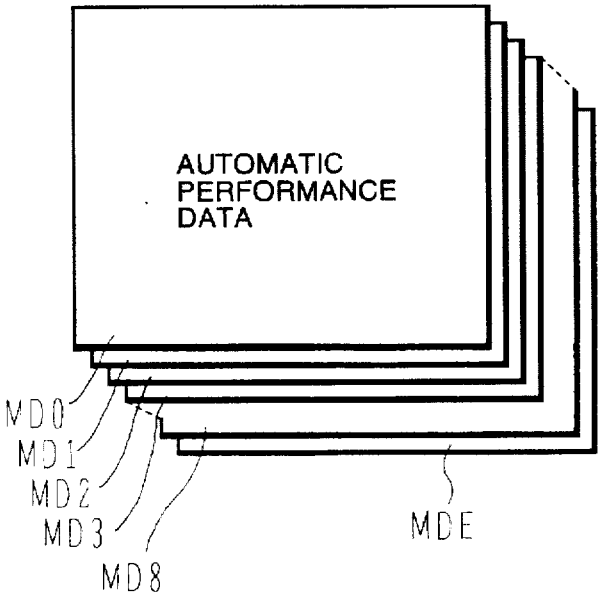

FIG. 22C shows the format of the automatic performance data for training programs. Automatic performance data PD1 to PD8 is used in a training program performance Mode 4 to be described later, the automatic performance data being provided in correspondence with the registration switches. The performance data PD1 to PD8 for the training programs includes performance assistance data such as obligato, backing, ensemble, and philharmonic, respectively serving as a melody guide. A performer can play a melody on the keyboard to the accompaniment of each automatic performance.

In the training program performance mode, the automatic performance of the performance assistance data helps a performer who cannot remember the melody. The automatic performance data for a training program does not contain a melody because it has been silenced, for example, by a minus-one function. The melody can be easily recollected by listening such an automatic performance of a training program.

In order not to disturb the manual performance on the keyboard, it is preferable that the automatic performance data contains guide sounds at a low volume for the performance assistance. The tone color of a guide sound may be different from the tone color of a melody during a manual performance.

Figure 22D:
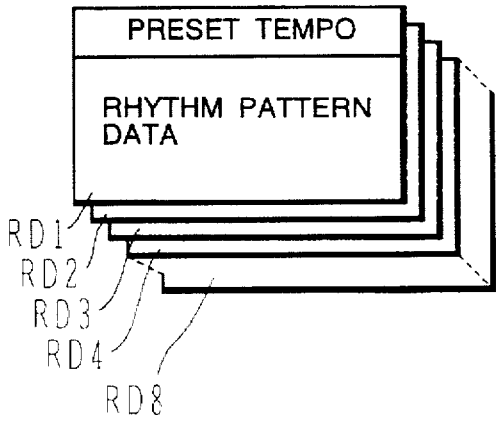

FIG. 22D shows the pattern of rhythm data. There are eight rhythm pattern data RD1 to RD8 in correspondence with the eight registration switches. Each data RD has a rhythm pattern data and preset tempo data matching the rhythm.

Figures 23, 24:
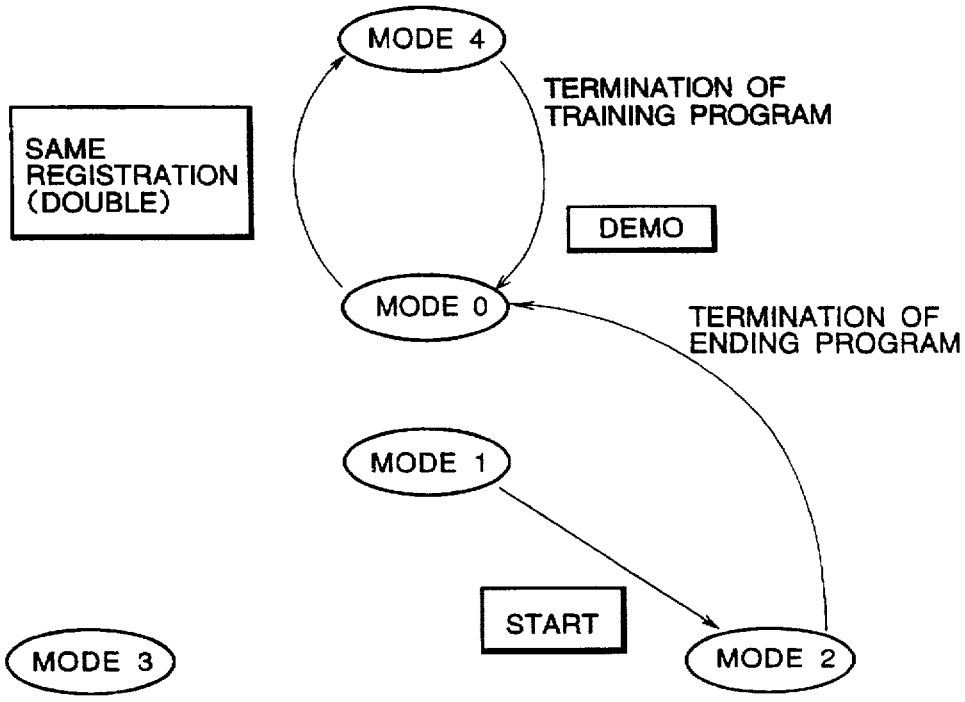
FIG. 23 is a table showing other examples of the operating modes of the electronic musical instrument.
FIG. 24 is a mode transition diagram showing transitions between the operating modes as a modified version of the mode transition diagram of FIG. 5.

FIG. 23 is a table showing the operating modes of the electronic musical instrument. The operating modes include Mode 4 in addition to Mode 0 to Mode 3.

Mode 0 is a manual performance mode allowing a manual performance on the keyboard by a performer. Mode 1 is a demonstration program selection mode allowing an input of a selected demonstration program by a performer. Mode 3 is a single demonstration performance mode allowing an automatic performance of a demonstration program having a musical style selected by the registration switch.

In Mode 2 of the previously described embodiment, the automatic performance starts from the opening demonstration program MD0, and after all the demonstration programs are automatically performed, the demonstration program MD1 is again performed to repeat the automatic performance. However, if the automatic performance starts always from the opening demonstration program each time Mode 2 enters, the demonstration program arranged at the later stage cannot be performed at an earlier time. In view of this, a new start switch is provided. When this start switch is depressed, the demonstration program previously terminated in Mode 2 is automatically performed. The automatic performance is terminated after the ending program MDE is performed without continuing the automatic performance cyclically and endlessly.

In the training program performance Mode 4, the training program automatic performance supplies performance assistance information together with which the performer can play the program on the keyboard.

FIG. 24 shows a transition state of Mode 4 added to the operating mode transition diagram shown in FIG. 5. When the presently set registration switch with the turned-on LED is double clicked in Mode 0, the operating mode transits to Mode 4 (training program performance mode). A double click is defined in this embodiment as two consecutive depressions of the same switch in a predetermined time (e.g., 1 second).

A switch may be depressed by a mistouch by a performed. A double click is generally effected with a positive intention of a performer. Therefore, if a mode transition is permitted only when a double click is entered, it is possible to eliminate a fault operation by a mistouch. A plurality of switch operations in a predetermined short time may be regarded as a single switch operation when switch chattering is taken into consideration.

In the training program performance Mode 4, a training program corresponding to the double clicked registration switch is automatically performed. When the automatic performance of the training program is completed, the operating mode returns to the manual performance Mode 0.

Furthermore, when the demonstration switch on the panel is depressed in Mode 4, the automatic performance of the training program is temporarily stopped to return to the manual performance Mode 0.

As described with FIG. 5, when the registration switch or demonstration switch is depressed in the all demonstration program performance Mode 2, the continuous automatic performance of demonstration programs is terminated and the operating mode transits to another mode. In this case, the serial number of the terminated demonstration program is stored in the register in RAM.

When the operation mode again returns thereafter to the demonstration selection Mode 1 and the start switch on the panel is depressed, the operating mode transits to the all demonstration program performance Mode 2 to resume the continuous automatic performance of the demonstration programs starting from the program having the serial number of the program terminated in the previous Mode 2.

When the automatic performance of the ending program MDE is completed in the all demonstration program performance Mode 2, the demonstration program automatic performance is terminated and the operating mode transits to the manual performance Mode 0.

Figure 25:
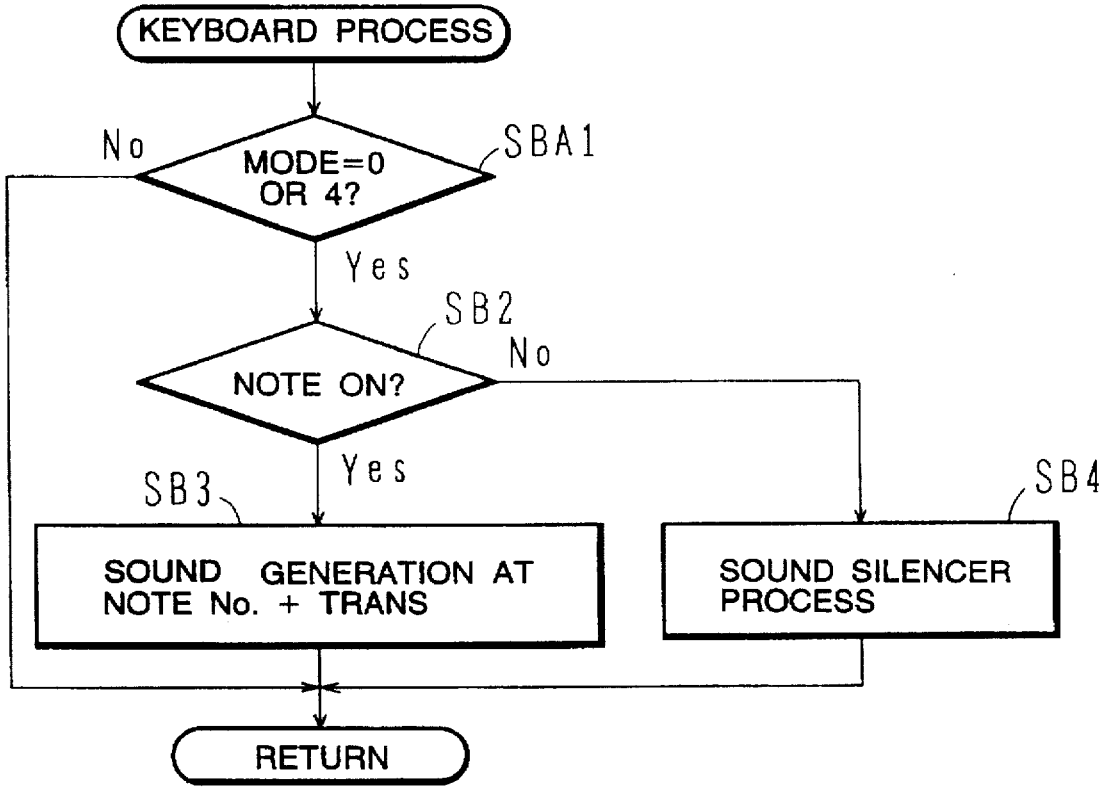
FIG. 25 is a flow chart explaining a modified process of the keyboard process shown in FIG. 7.

FIG. 25 is a flow chart explaining a modified process of this embodiment of the keyboard process shown in FIG. 7.

An additional step is Step SBA1. In the previous embodiment, the keyboard process is performed only when the mode register MODE is "0". Addition of the training program performance Mode 4 allows the keyboard process to be executed also in Mode 4.

At Step SB1, it is checked whether the mode register MODE is "0" or "4". If not "0" and "4", the manual performance on the keyboard is not acknowledged, the keyboard process is terminated, and the process returns to the main routine shown in FIG. 6.

If the mode register MODE is "0" or "4", the manual performance on the keyboard by the performer is permitted. At Step SB2 it is checked whether a key event detected from the keyboard is an on-note or not. If on-note, at Step SB3 the note number of the key detected with the on-note is added to the value in the musical key transposition register TRANS, and the resultant value is supplied to the sound source. Thereafter, the flow returns to the main routine.

If the key event is not an on-note at Step SB2, it means an off-note so that at Step SB4 the sound generated by the sound system is silenced by a sound silencer process. Thereafter, the flow returns to the main routine of FIG. 6.

Figure 26:
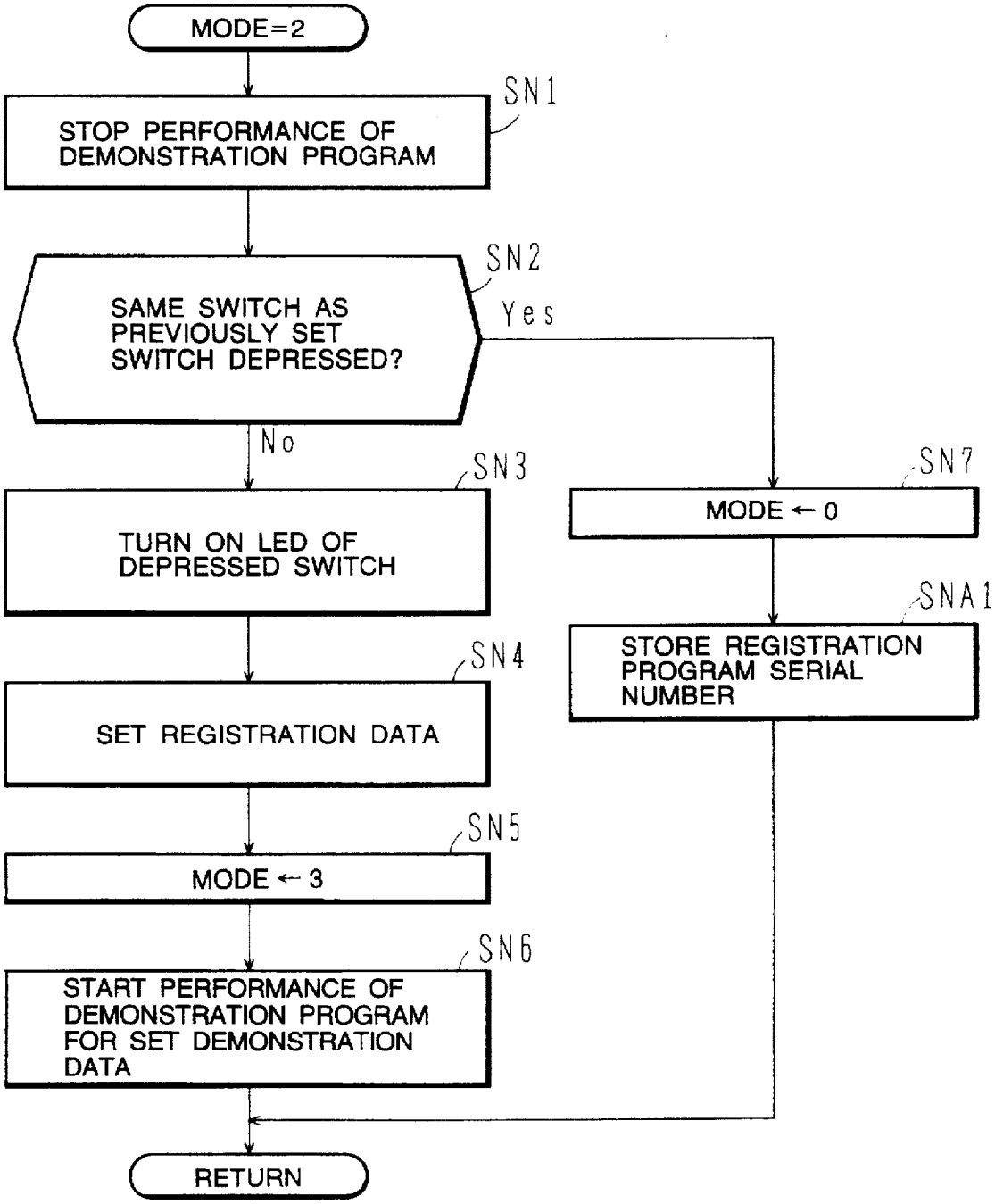
FIG. 26 is a flow chart explaining a modified process of the registration switch process shown in FIG. 16.

FIG. 26 is a flow chart explaining a modified process of this embodiment of the registration switch process shown in FIG. 19. This flow chart explains the process to be executed when a registration switch is depressed in the all demonstration program performance Mode 2.

When a registration switch is depressed in Mode 2, the continuous automatic performance of demonstration programs is terminated, and the operating mode transits to Mode 0. In this embodiment, after this process, Step SNA1 is added for storing the serial number of the demonstration program last performed. The added process will be described below.

At Step SN1, the automatic performance of a demonstration program is stopped when a registration switch is depressed.

At Step SN2 it is checked whether the same registration switch as the previously performed demonstration program with the presently turned-on LED has been depressed. If the same registration switch, at Step SN7 "0" is set to the mode register MODE to transit to the manual performance mode. Thereafter, the flow returns to the main routine of FIG. 6.

At Step SNA1, the serial number of the demonstration program last performed (the program terminated at Step SN1) is stored in the register. Thereafter, the flow returns to the main routine of FIG. 6.

Steps SN3 to SN6 are the same as described with FIG. 19.

Figure 27:
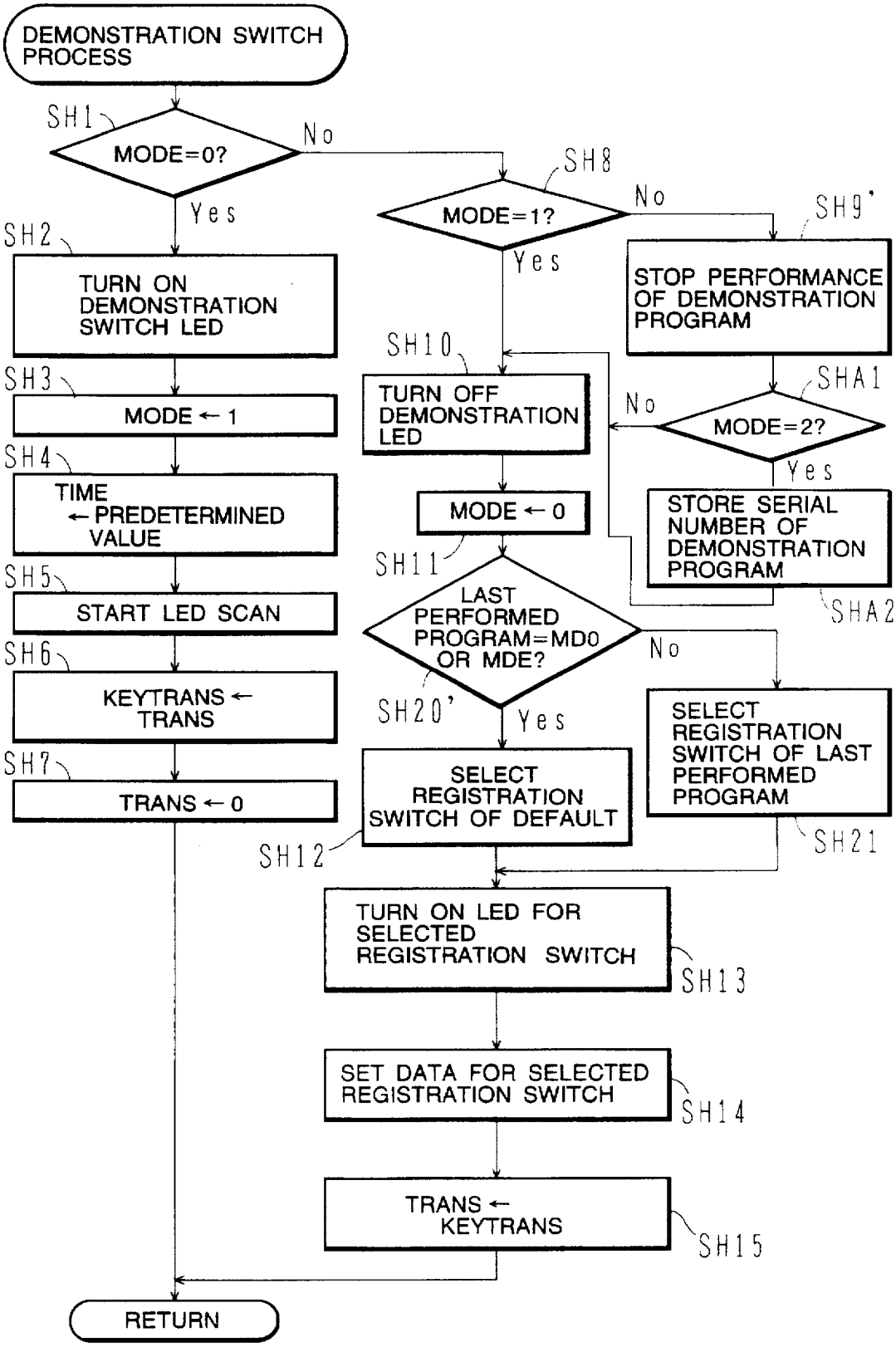
FIG. 27 is a flow chart explaining a modified process of the demonstration switch process shown in FIG. 13.

FIG. 27 is a flow chart explaining a modified process of this embodiment of the demonstration switch process shown in FIG. 13. This flow chart explains the process to be executed when a demonstration switch is depressed in Mode 2.

When a demonstration switch is depressed, the continuous automatic performance of demonstration programs is terminated, and the operating mode transits to Mode 0. In this embodiment, after this process, Steps SHA1 and SHA2 are added for storing the serial number of the demonstration program last performed.

Step SH20' checks not only the opening program MD0 but also the ending program MDE. The added process will be described below.

It is checked at Step SH1 whether the mode register MODE is "0" or not. If not "0", it is checked at Step SH8 whether the mode register MODE is "1" or not. If not, the operating mode is one of the automatic performance Modes 2, 3, and 4. At Step SH9', the automatic performance of the demonstration program (in Mode 2) or the training program (in Mode 4) is stopped. The flow advances to Step SHA1.

At Step SHA1 it is checked whether the mode register MODE is "2" or not. If "2", the flow advances to Step SHA2 whereat the serial number of the demonstration program terminated at Step SH9' is stored for preparation of a restart by the start switch. Thereafter, the flow advances to Step SH10.

If the mode register MODE is not "2" at Step SHA1, then the operating mode is either Mode 3 (single demonstration program performance mode) or Mode 4 (training program performance mode). Therefore, the flow advances to Step SH10 without storing the serial number of the demonstration program. At Step SH10 the LED for the demonstration switch is turned off, and at Step SH11 the mode register MODE is set with "0" to transfer to the manual performance mode. In any one of Modes 1 to 4, the operating mode transits to Mode 0 when the demonstration switch is depressed.

At Step SH20' it is checked whether the demonstration program last performed prior to depressing the demonstration switch is the opening program (MD0) or the ending program (MDE). If not, at Step SH21 the registration switch corresponding to the demonstration program last performed is selected.

If the last performed demonstration program is the opening program (MD0) or the ending program (MDE), there is no corresponding registration switch, and at Step SH12 a default registration switch is selected.

The following Steps SH13 to SH15 are the same as described with FIG. 13. Thereafter, the flow returns to the main routine of FIG. 6.

Steps SH2 to SH7 are the same as described with FIG. 13.

With the process described above, the serial number of the demonstration program immediately before the transition from Mode 2 is stored in the register. Thereafter, when the start switch is depressed in the demonstration selection Mode 1, the operating mode transits to the all demonstration program performance Mode 2 to start the automatic performance of the demonstration program whose serial number is being stored in the register.

The start switch is one of the rhythm control switches 18 on the panel shown in FIG. 3, and serves also as the rhythm start switch.

Figure 28:
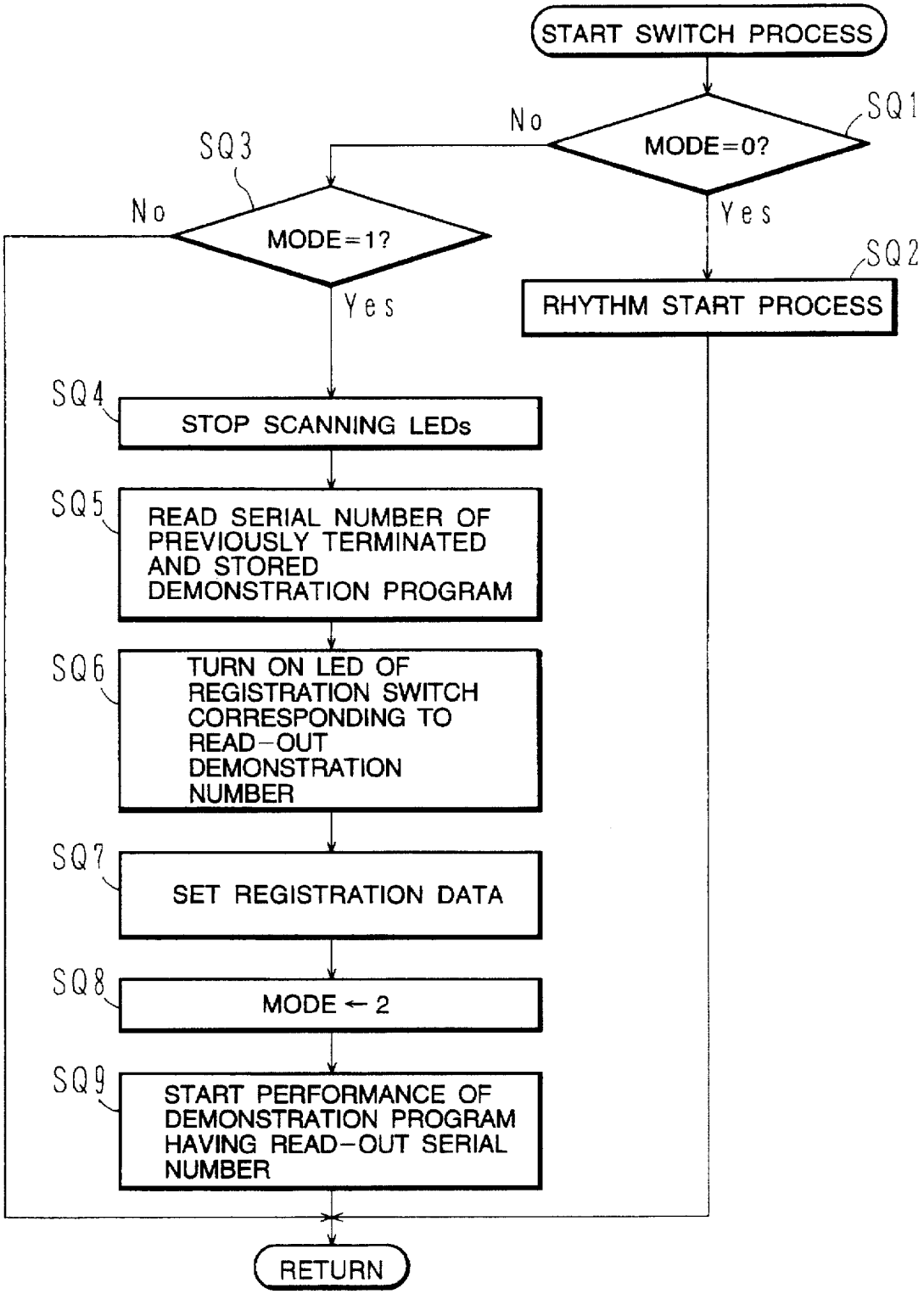
FIG. 28 is a flow chart explaining the operation to be executed after a start switch is depressed.

FIG. 28 is a flow chart explaining the process to be executed when the start switch is depressed.

At Step SQ1 it is checked whether the mode register MODE is "0" or not. If "0", it means the manual performance mode, and at Step SQ2 a rhythm start process is performed. Thereafter, the flow returns to the main routine of FIG. 6.

If it is judged that the mode register MODE is not "0", at Step SQ3 it is checked whether the mode register is "1" or not. If not "1", the operating mode is one of Modes 2, 3, and 4 so that the process is terminated.

If the mode register MODE is "1", at Step SQ4, scanning the LEDs of the registration switches is stopped to inform the performer of the end of the demonstration program selection state. At Step SQ5 the serial number of the previously terminated demonstration program stored in the demonstration number register is read. For example, as the initial value of the demonstration program number, the serial number of the opening program MD0 is stored as the default. At Step SQ6, the LED of the registration switch corresponding to the read demonstration program number is turned on, and the corresponding registration data is set at Step SQ7.

At Step SQ8 "2" is set to the mode register MODE and the operating mode transits to the all demonstration program performance mode. At Step SQ9 the demonstration program having the read demonstration program number starts being automatically performed, and thereafter the flow returns to the main routine of FIG. 6.

Figure 29:
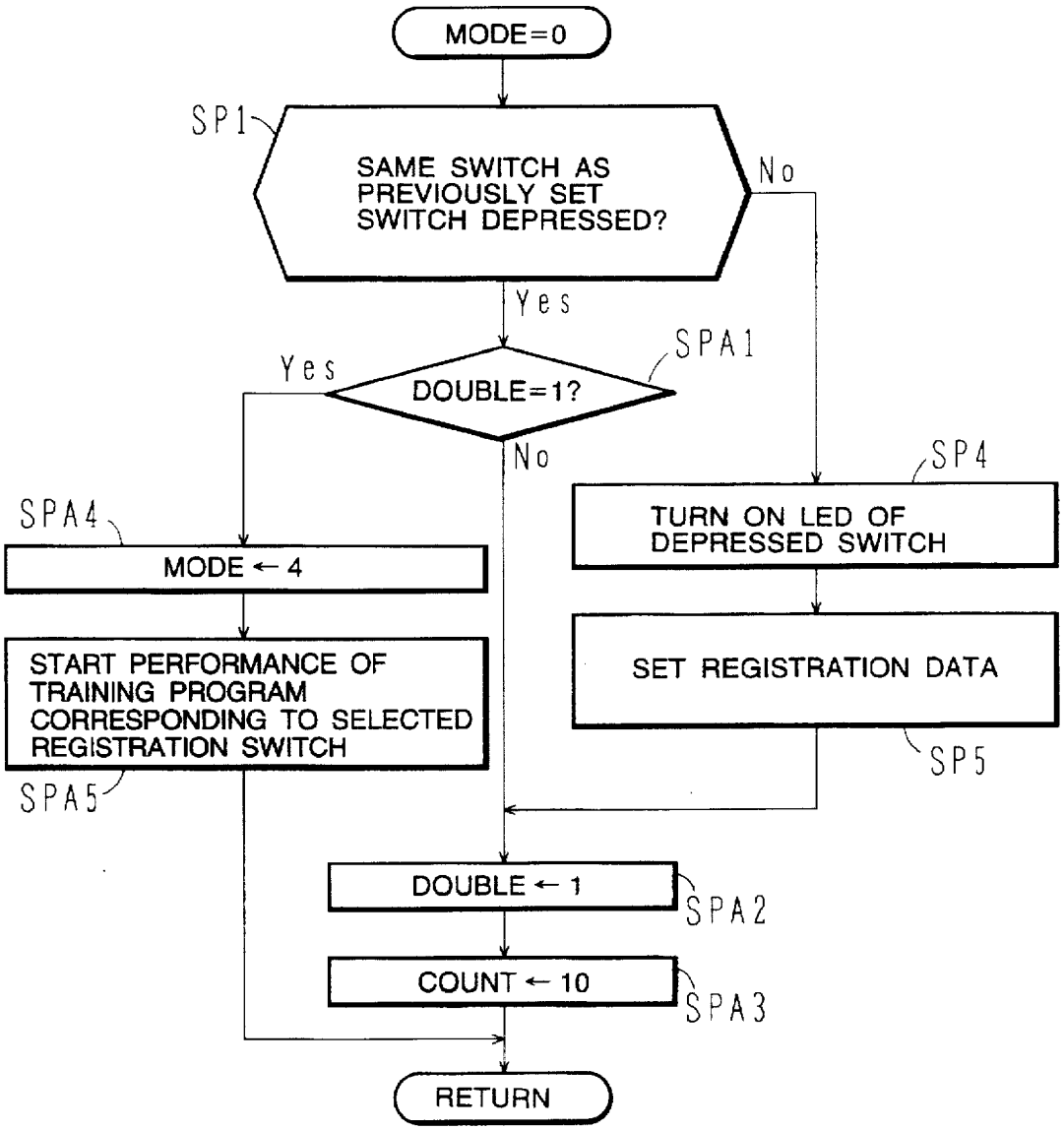
FIG. 29 is a flow chart explaining a modified process of the registration switch process shown in FIG. 21.

FIG. 29 is a flow chart explaining the process to be executed when a registration switch is depressed in Mode 0. This flow chart is a modified flow chart shown in FIG. 21 in which a transition from Mode 0 to Mode 4 is possible. If a registration switch is double clicked in Mode 0, the operating mode transits to Mode 4.

At Step SP1 it is checked whether the same registration switch as the presently depressed registration switch with the turned-on LED is depressed. If a different registration switch is depressed, at Step SP4 the LED of the previously set registration switch is turned off and the LED of the newly set registration switch is turned on. At Step SP5 the registration data for the depressed switch is set, and thereafter the flow advances to Step SPA2.

If the same registration switch is depressed at Step SP1, it is checked at Step SPA1 whether a double click flag DOUBLE for indicating a double click depression is "1". Since the flag DOUBLE is set to "0" at the initial condition, the flow initially advances to Step SPA2.

At Step SPA2 the flag DOUBLE is set to "1", and at Step SPA3 "10" is stored in a timer register COUNT to terminate the process. The register COUNT stores an operation time limit for a double click. For example, if "10" is stored in the register COUNT, a double click is detected when the switch is consecutively depressed twice in one second (10 ms×10).

In order to count one second, the value in the register COUNT is decremented by a predetermined time interval. This process will be described with reference to FIG. 30.

Figure 30:
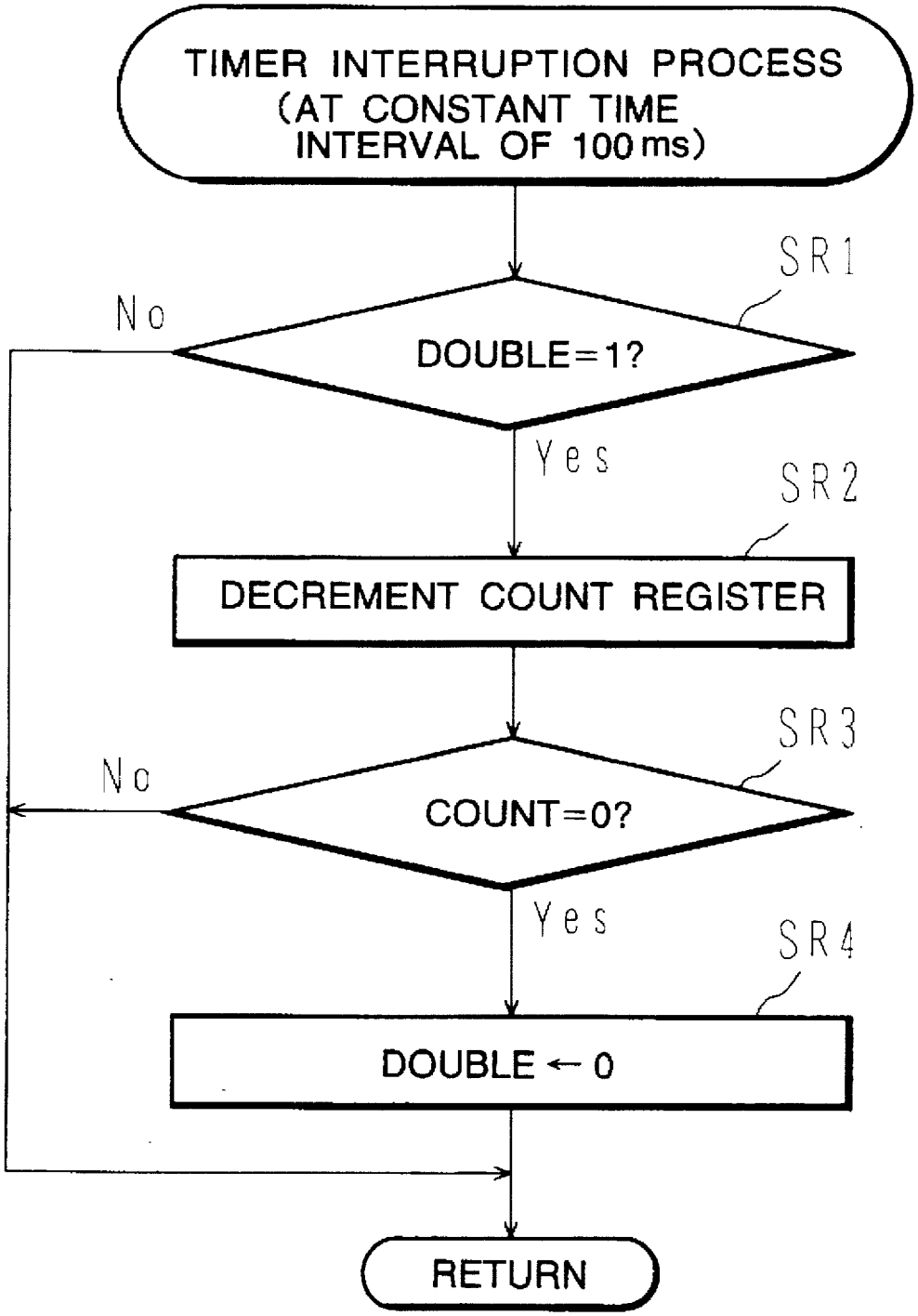
FIG. 30 is a flow chart explaining the timer interrupt process by a timer register COUNT.

FIG. 30 is a flow chart explaining the timer interrupt process by the timer register COUNT whose contents are decremented. In this embodiment, the interrupt process is assumed to be performed at a constant time interval, for example, at 100 ms interval.

At Step SR1 it is checked whether the flag DOUBLE is "1" or not. If not "1", it means that a registration switch has not been depressed at all in the predetermined time so that the process is terminated.

If the flag DOUBLE is "1", the value of the register COUNT is decremented. At Step SR3 it is checked whether the decremented value of the register COUNT is "0" or not. If not, it means the predetermined time (e.g., one second) has not lapsed as yet so that the flow returns to the original process (process executed prior to the interrupt process).

If the register COUNT is "0", it means a lapse of the predetermined time. Therefore, at Step SR4 the flag DOUBLE is reset to "0" and the flow returns to the original process. That is to say, the flag DOUBLE is reset to "0" after a lapse of the predetermined time (e.g., one second) after it is set to "1".

If the flag DOUBLE is judged to be "1" at Step SPA1 shown in FIG. 29, it means that after the registration switch is once depressed and the flag DOUBLE is set to "1", the same registration switch is depressed again before the flag DOUBLE is reset. Since the same registration switch is depressed twice in the predetermined time, the flow advances to Step SPA4.

At Step SPA4 the mode register MODE is set with "4" to transit to the training program performance mode. At Step SPA5 the training program performance data corresponding to the presently selected registration switch is read from ROM to start the automatic performance thereof. Thereafter, the flow returns to the main routine.

Next, the process of transitting to Mode 0 after the completion of the automatic performance of a training program in Mode 4 will be described.

Figure 31:
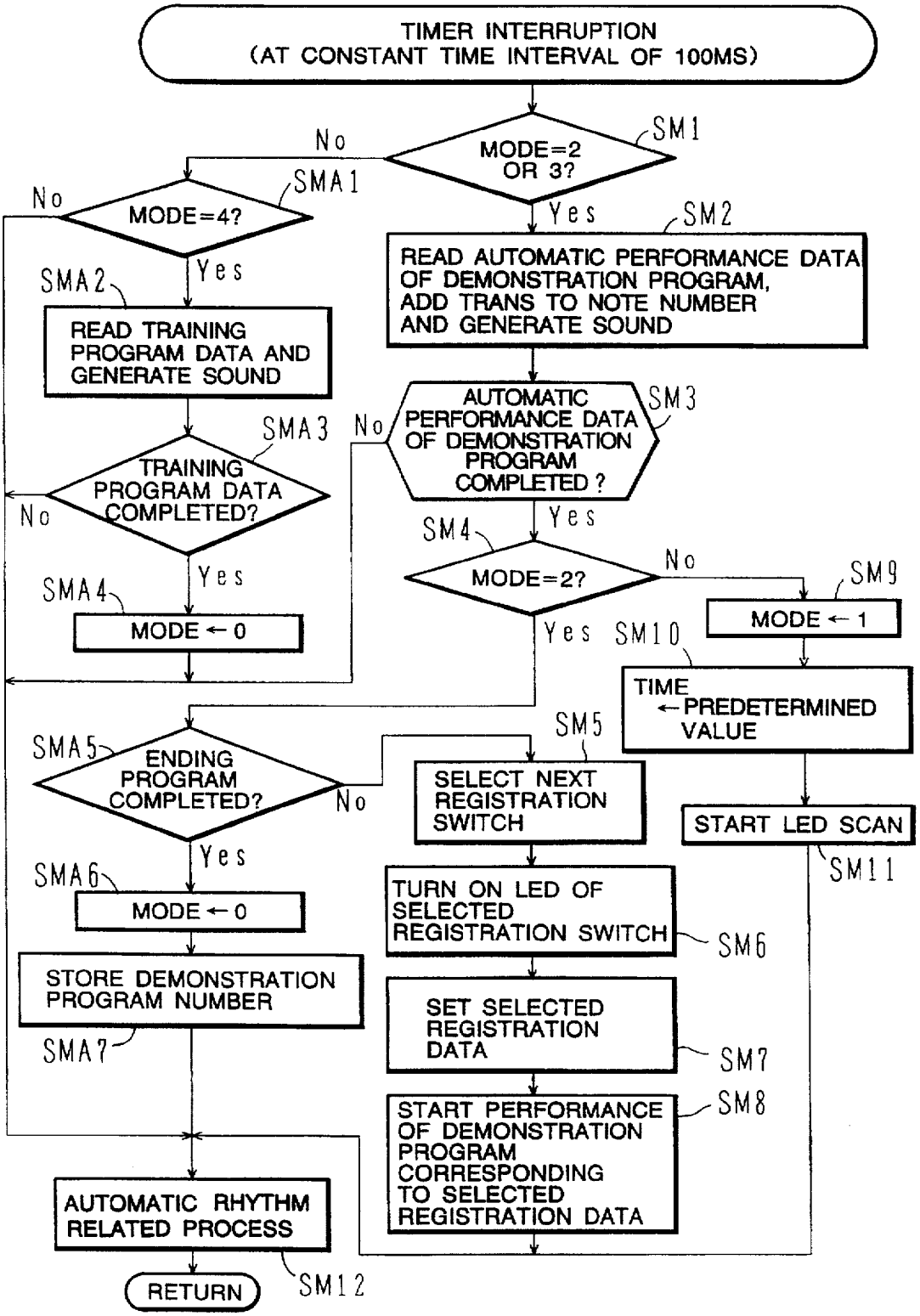
FIG. 31 is a flow chart explaining a modified process of the interrupt process shown in FIG. 18.

FIG. 31 is a flow chart explaining a modified process of this embodiment of the interrupt process shown in FIG. 18. The interrupt process is executed at a time interval corresponding to the tempo speed set by registration data.

At Step SM1 it is checked whether the mode register MODE is "2" or "3". At Step SMA1 it is checked whether the mode register MODE is "4". If not Mode 4, the automatic performance is not effected, but at Step SM12 an automatic accompaniment performance starts in accordance with the set rhythm data. Thereafter, the process executed prior to the interrupt process resumes.

If the operating mode is Mode 4 at SAM1, the automatic performance process starts at SMA2 wherein the automatic performance data of a training program is read from ROM, and supplied to the sound source. In accordance with the musical tone signal from the sound source, the sound system generates a sound.

It is checked at Step SMA3 whether the automatic performance data of the training program has been completed. If not, the training program is under performance, and at Step SM12 the automatic accompaniment is performed in accordance with the presently set rhythm data. Thereafter, the process executed prior to the interruption process resumes.

If the automatic performance data of the training program has been completed at Step SM3, the flow advances to Step SMA4 whereat "0" is set to the mode register MODE to transit to the manual performance mode. Thereafter, at Step SM12 the automatic accompaniment performance at the set rhythm data is carried out and the process executed prior to the interrupt process resumes.

If it is judged at Step SM1 that the mode register MODE is "2" or "3", it means the automatic performance mode of a demonstration program. At Step SM2 the automatic performance data of a demonstration program is read from ROM, and the value in the musical key transposition register TRANS is added to the read note number (pitch data). The resultant pitch data is supplied to the sound source to generate a sound at the sound system.

It is checked at Step SM3 whether the automatic performance data of the demonstration program has been completed. If not, the demonstration is under performance, and at Step SM12, the automatic accompaniment is performed in accordance with the presently set rhythm data. Thereafter, the process executed prior to the interruption process resumes.

If it is judged at Step SM3 that the automatic performance data of the demonstration program has been completed, at Step SM4 it is checked whether the mode register MODE is "2" or not.

If not, it means that the automatic performance of the demonstration has been completed in the single demonstration performance Mode 3. Therefore, at Step SM9 "1" is set to the mode register MODE to transit to the demonstration program selection mode.

At Step SM10 a predetermined value (e.g., 30) is stored in the timer register TIME to start a timer count operation. At Step SM11 the LEDs of the registration switches start being scanned to inform the performer of the demonstration program selection state. Thereafter, at Step SM12 the automatic accompaniment at the set rhythm data is carried out and the process executed prior to the interrupt process resumes.

If it is judged at Step SM4 that the mode register MODE is "2", it is checked at Step SMA5 whether the automatic performance data of the demonstration program judged to be completed is the ending program MDE or not. If the ending program, at Step SMA6 "0" is set to the mode register MODE to transit to the manual performance mode.

After the completion of the automatic performance, at Step SMA7 the serial number of the ending program is stored in the register for the preparation of restarting by the start switch. Thereafter, at Step SM12 the automatic performance at the set rhythm data is carried out and the process executed prior to the interrupt process resumes.

If it is judged at Step SMA5 that the completed demonstration program is not the ending program, at Step SM5 the registration data for the next serial number of the completed demonstration program is set. The demonstration programs are selected in the order of MD0, MD1, MD2, . . . , MD8, and MDE which is the last program to be selected.

At Step SM6 the LED of the selected registration switch is turned on. At Step SM7 the selected registration data is set. At Step SM8 the automatic performance data of the demonstration program for the selected registration data starts. Thereafter, at Step SM12 an automatic accompaniment at the set rhythm data is performed and the process executed prior to the interrupt process resumes.

As above, with the provision of the training program performance Mode 4, a performer can comfortably play and train a melody on the keyboard while listening guide sounds under automatic performance.

When a performer doable clicks a registration switch, the operating mode transits from the manual performance Mode 0 to the training program performance Mode 4. Therefore, a mode transition can be reliably and readily attained without any fault manipulation such as mistouch.

The mode transition by a double click is not limited only from Mode 0 to Mode 4, but other mode transitions may be used.

The present invention has been described in connection with the preferred embodiments. The invention is not limited only to the above embodiments. It is apparent to those skilled in the art that various modifications, improvements, combinations and the like can be made without departing from the scope of the appended claims.

We claim:

1. An electronic musical instrument comprising:

mode selecting means for selecting a mode from a plurality of modes including an automatic performance mode and a manual performance mode;

musical style storing means for storing performance atmosphere data of a plurality of musical styles, wherein the performance atmosphere data includes data including at least one of tempo data, effect to be imparted data and tone volume data;

performance data storing means for storing performance data of a plurality of programs each matching one of said musical styles;

a musical style selection member responsive to manipulation by a performer for selecting a musical style from said performance atmosphere data stored in said musical style storing means;

musical tone signal generating means for generating a musical tone signal in accordance with a musical tone parameter; and musical tone parameter outputting means for outputting said musical tone parameter to said musical tone signal generating means during the automatic performance mode in accordance with the performance atmosphere data representing the musical style selected by said musical style selection member and the performance data of a program suitable for the musical style.

2. An electronic musical instrument according to claim 1, further comprising sound information generating means responsive to an operation of a performer for generating sound information, wherein said musical tone parameter outputting means outputs said musical tone parameter to said musical tone signal generating means during the manual performance mode in accordance with the performance atmosphere data representing the musical style selected by said musical style selection member and the sound information generated by said sound information generation means.

3. An electronic musical instrument according to claim 2, further comprising a continuous performance mode, wherein said musical tone parameter outputting means outputs said musical tone parameter to said musical tone signal generating means during the continuous performance mode in accordance with the performance atmosphere data representing the musical style and stored in said musical style storing means and in accordance with the performance data matching the musical style, said performance atmosphere data and said performance data being sequentially and continuously selected independently from said musical style selection member.

4. An electronic musical instrument according to claim 3, further comprising:

last performed program storing means for storing an identifier of a program last selected when said musical tone parameter outputting means stops an output of the musical tone parameter in the continuous performance mode; and a restart manipulation member for restarting an output of the musical tone parameter by said musical tone parameter outputting means, wherein said musical tone parameter outputting means responds to an operation by said restart manipulation member, sequentially and continuously selects the programs starting from the program with the identifier stored in said last performed program storing means, and outputs musical tone parameters in the continuous performance mode.

5. An electronic musical instrument according to claim 2, further comprising:

musical key transposition designating means responsive to an operation by a performer for generating musical key transposition data for the automatic performance mode or the manual performance mode;

musical key transposition storing data storing means for storing the musical key transposition data generated by said musical key transposition designating means;

musical key transposition data saving means for temporarily saving, in the automatic performance mode, the musical key transposition data stored in the manual performance mode in said musical key transposition data storing means; and musical key transposition recovering means for recovering the musical key transposition data saved in said musical key transposition data saving means and storing the data in said musical key transposition data storing means, when the manual performance mode resumes after the automatic performance mode, wherein said musical tone parameter outputting means includes means for transposing the performance data stored in said performance data storing means, in accordance with the musical key transposition data stored in said musical key transposition data storing means in the automatic performance mode, and said musical tone parameter outputting means includes means for transposing the sound information generated by said sound information generating means, in accordance with the musical key transposition data stored in said musical key transposition data storing means when the manual performance mode resumes after the automatic performance mode, and for outputting a musical tone parameter in accordance with the transposed sound information.

6. An electronic musical instrument comprising:

mode selecting means for selecting a mode from a plurality of modes including an automatic performance mode; a continuous performance mode and a manual performance mode;

musical style storing means for storing performance atmosphere data of a plurality of musical styles;

performance data storing means for storing performance data of a plurality of programs each matching one of said musical styles;

a musical style selection member responsive to a manipulation by a performer for selecting a musical style from said performance atmosphere data stored in said musical style storing means;

musical tone signal generating means for generating a musical tone signal in accordance with a musical tone parameter; and musical tone parameter outputting means for outputting said musical tone parameter to said musical tone signal generating means during the automatic performance mode, in accordance with the performance atmosphere data representing the musical style selected by said musical style selection member and the performance data of a program suitable for the musical style, wherein said musical tone parameter outputting means outputs said musical tone parameter to said musical tone signal generating means during the continuous performance mode in accordance with the performance atmosphere data representing the musical style and stored in said musical style storing means and in accordance with the performance data matching the musical style, said performance atmosphere data and said performance data being sequentially and continuously selected independently from said musical style selection member.

7. An electronic musical instrument according to claim 6, further comprising:

last performed program storing means for storing an identifier of a program last selected when said musical tone parameter outputting means stops an output of the musical tone parameter in the continuous performance mode; and a restart manipulation member for restarting an output of the musical tone parameter by said musical tone parameter outputting means, wherein said musical tone parameter outputting means responds to an operation by said restart manipulation member, sequentially and continuously selects the programs starting from the program with the identifier stored in said last performed program storing means, and outputs musical tone parameters in the continuous performance mode.

8. An electronic musical instrument comprising:

mode selecting means for selecting a mode from a plurality of modes including an automatic performance mode and a manual performance mode;

musical style storing means for storing performance atmosphere data of a plurality of musical styles;

performance data storing means for storing performance data of a plurality of programs each matching one of said musical styles;

a musical style selection member responsive to a manipulation by a performer for selecting a musical style from said performance atmosphere data stored in said musical style storing means;

musical tone signal generating means for generating a musical tone signal in accordance with a musical tone parameter; and musical tone parameter outputting means for outputting said musical tone parameter to said musical tone signal generating means during the automatic performance mode, in accordance with the performance atmosphere data representing the musical style selected by said musical style selection member and the performance data of a program suitable for the musical style; and double click detecting means for detecting whether a performer double clicks said musical style selection member, wherein said musical tone parameter outputting means selects a musical tone and generates a musical tone parameter when said double click detecting means detects a double-click.

9. An electronic musical instrument comprising:

mode selecting means for selecting a mode from a plurality of modes including an automatic performance mode and a manual performance mode;

musical style storing means for storing performance atmosphere data of a plurality of musical styles;

performance data storing means for storing performance data of a plurality of programs each matching one of said musical styles;

a musical style selection member responsive to a manipulation by a performer for selecting a musical style from said performance atmosphere data stored in said musical style storing means;

musical tone signal generating means for generating a musical tone signal in accordance with a musical tone parameter; and musical tone parameter outputting means for outputting said musical tone parameter to said musical tone signal generating means during the automatic performance mode, in accordance with the performance atmosphere data representing the musical style selected by said musical style selection member and the performance data of a program suitable for the musical style wherein the performance atmosphere data stored in said musical style storing means includes tempo data for determining a tempo of musical performance.

10. An electronic musical instrument comprising:

mode selecting means for selecting a mode from a plurality of modes including an automatic performance mode and a manual performance mode;

musical style storing means for storing performance atmosphere data of a plurality of musical styles;

performance data storing means for storing performance data of a plurality of programs each matching one of said musical styles;

a musical style selection member responsive to a manipulation by a performer for selecting a musical style from said performance atmosphere data stored in said musical style storing means;

musical tone signal generating means for generating a musical tone signal in accordance with a musical tone parameter; and musical tone parameter outputting means for outputting said musical tone parameter to said musical tone signal generating means during the automatic performance mode, in accordance with the performance atmosphere data representing the musical style selected by said musical style selection member and the performance data of a program suitable for the musical style wherein the performance atmosphere data stored in said musical style storing .means includes musical style tempo data representing a tempo corresponding to the musical style and rhythm data representing a rhythm, the electronic musical instrument further comprising:

rhythm tempo storing means for storing rhythm tempo data representing a tempo corresponding to said rhythm data; and a tempo selection member responsive to an operation by a performer for selecting either a tempo matching a musical style or a tempo matching a rhythm, and wherein said musical tone parameter output means outputs the musical tone parameter in accordance with the musical style tempo data when said tempo selection member selects the tempo matching a musical style, and outputs the musical tone parameter in accordance with the rhythm tempo data when said tempo selection member selects the tempo matching a rhythm.

11. An electronic musical instrument comprising:

first performance data storing means for storing performance data;

second performance data storing means for storing performance assistance data for use in assisting performance;

sound information generating means for generating sound information in response to an operation by a performer;

a selection member for selecting a first performance mode or a second performance mode;

musical tone parameter outputting means for outputting a musical tone parameter in accordance with the performance data stored in said first performance data storing means when said first performance mode is selected by said selection member, and for outputting a musical tone parameter in accordance with the performance assistance data stored in said second performance data storing means and the sound information generated by said sound information generating means when said second performance mode is selected by said selection member; and musical tone signal generating means for generating a musical tone signal in accordance with the musical tone parameter outputted by said musical tone parameter outputting means.

12. A method of generating a musical tone signal of an electronic musical instrument, the instrument storing performance atmosphere data representative of a plurality of musical styles and performance data of a plurality of programs suitable for each of the plurality of musical styles, the method comprising the steps of:

selecting a mode from a plurality of modes including an automatic performance mode and a manual performance mode;

selecting a musical style from the plurality of musical styles by an operation of a performer;

generating a first musical tone parameter in the automatic performance mode in accordance with the performance atmosphere data representative of the selected musical style and the performance data suitable for the selected musical style, wherein the performance atmosphere data includes data including at least one of tempo data, effect to be imparted data and tone volume data; and generating a musical tone signal in accordance with musical tone parameters including said first musical tone parameter.

13. A method according to claim 12, further comprising the steps of:

generating sound information in responsive to an operation of a performer; and generating a second musical tone parameter in the manual performance mode in accordance with the performance atmosphere data representative of the selected musical style and the generated sound information, said musical tone parameters including said second musical tone parameter.

14. A method according to claim 12, further comprising the step of generating a second musical tone parameter in accordance with the stored performance atmosphere data representing the musical style and the performance data matching the musical style, said performance atmosphere data and said performance data being sequentially and continuously selected independently from the selection of the musical style, said musical tone parameters including said second musical tone parameter.

15. A method according to claim 13, further comprising the step of generating a third musical tone parameter in accordance with the stored performance atmosphere data representing the musical style and the performance data matching the musical style, said performance atmosphere data and said performance data being sequentially and continuously selected independently from the selection of the musical style, said musical tone parameters including said third musical tone parameter.

16. A method according to claim 14, further comprising the steps of:

storing an identifier of a program last selected when generation of said second musical tone parameter is stopped; and restarting generation of the second musical tone parameter by sequentially and continuously selecting the programs starting from the last selected program.

17. A method according to claim 15, further comprising the steps of:

storing an identifier of a program last selected when generation of said third musical tone parameter is stopped; and restarting generation of the third musical tone parameter by sequentially and continuously selecting the programs starting from the last selected program.

18. A method according to claim 12, wherein said step of selecting the musical style includes the step of detecting whether a performer double clicks a manipulation member.

19. A method according to claim 12, wherein the stored performance atmosphere data includes musical style tempo data representing a tempo corresponding to the musical style and rhythm data representing a rhythm, and the electronic musical instrument stores rhythm tempo data representing a tempo corresponding to the rhythm data, the method further including the step of selecting either a tempo matching a musical style or a tempo matching a rhythm in response to an operation by a performer, and wherein the first musical tone parameter is generated in accordance with the musical style tempo data when the tempo matching a musical style is selected and in accordance with the rhythm tempo data when the tempo matching a rhythm is selected.

20. A method according to claim 13, wherein the stored performance data includes pitch information, the method further comprising the steps of:

generating musical key transposition data for the automatic performance mode or the manual performance mode, in response to an operation of a performer;

temporarily saving, in the automatic performance mode, the generated musical key transposition data stored in the manual performance mode; and recovering the saved musical key transposition data when the manual performance mode resumes after the automatic performance mode.

wherein said first musical tone parameter is generated by transposing the stored performance data in accordance with the musical key transposition data, and said second musical tone parameter is generated by transposing the generated sound information in accordance with the musical key transposition data.

21. A method of generating a musical tone signal of an electronic musical instrument, the instrument storing performance data and performance assistance data for use in assisting performance, the method comprising the steps of:

generating sound information in response to an operation by a performer;

selecting a first performance mode or a second performance mode;

generating a musical tone parameter in accordance with the performance data when said first performance mode is selected, and a musical tone parameter in accordance with the performance assistance data and the sound information when said second performance mode is selected; and generating a musical tone signal in accordance with the musical tone parameter.

* * * * *